US008238785B2

(12) United States Patent
Kawai

(10) Patent No.: US 8,238,785 B2
(45) Date of Patent: Aug. 7, 2012

(54) PROCESS CARTRIDGE AND IMAGE FORMING APPARATUS

(75) Inventor: Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 433 days.

(21) Appl. No.: 12/472,347

(22) Filed: May 26, 2009

(65) Prior Publication Data

US 2009/0297216 A1 Dec. 3, 2009

(30) Foreign Application Priority Data

May 27, 2008 (JP) ..... 2008-138044
Mar. 31, 2009 (JP) ..... 2009-086152

(51) Int. Cl.
*G03G 21/16* (2006.01)

(52) U.S. Cl. ..... 399/111

(58) Field of Classification Search ..... 399/110, 399/111, 113
See application file for complete search history.

(56) References Cited

U.S. PATENT DOCUMENTS 6,128,452 A * 10/2000 Miyabe et al. ..... 399/111 X
6,968,142 B2 * 11/2005 Arimitsu et al. ..... 399/111 X
7,116,925 B2 * 10/2006 Yamaguchi ..... 399/111
7,184,687 B2 * 2/2007 Yamaguchi et al. ..... 399/111

FOREIGN PATENT DOCUMENTS

JP 2006-145604 1/2006
JP 2006-276196 10/2006
JP 2007-219268 8/2007
JP 2007-219269 8/2007

* cited by examiner

*Primary Examiner* — Sandra Brase
(74) *Attorney, Agent, or Firm* — Canon USA Inc IP Division

(57) ABSTRACT

A process cartridge includes a first guided portion provided on a photosensitive member unit at a downstream side of a mounting direction of the process cartridge, a second guided portion provided along the mounting direction, and a third guided portion provided on a developing unit of the process cartridge along the mounting direction.

16 Claims, 15 Drawing Sheets

PROCESS CARTRIDGE AND IMAGE FORMING APPARATUS

BACKGROUND OF THE INVENTION

1. Field of the Invention

The present invention relates to a process cartridge, which is detachable from an apparatus body of an electrophotographic image forming apparatus, and to an image forming apparatus using the process cartridge.

2. Description of the Related Art

An image forming apparatus forms an image on a recording medium by using an electrophotographic image forming process. Examples of the image forming apparatus include an electrophotographic copying machine, an electrophotographic printer (a light-emitting diode (LED) printer, a laser beam printer, and the like), an electrophotographic facsimile machine, and an electrophotographic word processor.

Examples of the recording medium, on which an image is formed, include a recording sheet and an over head projector (OHP) sheet (viewgraph).

The process cartridge has such a configuration that at least one of a charging unit, a developing unit, and a cleaning unit, as a processing means, and an electrophotographic photosensitive drum are made into one piece to form a cartridge, which is detachable from the apparatus body. Therefore, the process cartridge also includes such a configuration that at least a developing unit as a processing unit and an electrophotographic photosensitive drum are made into one piece to form a cartridge, which is detachable from the apparatus body.

In the conventional electrophotographic image forming apparatus using the electrophotographic image forming process, such a process cartridge device is adopted that an electrophotographic photosensitive drum and a processing unit for acting on the electrophotographic photosensitive drum are integrally made into a cartridge so as to be detachable from the apparatus body. According to the process cartridge device, a user himself can perform maintenance of the apparatus without help from a service engineer. Therefore, operability can be improved remarkably. For this reason, the process cartridge system is widely used in the field of the electrophotographic image forming apparatus.

In the electrophotographic image forming apparatus, light corresponding to image information, for example, laser light, LED light, or light of a lump, is irradiated onto the electrophotographic photosensitive drum. Accordingly, an electrostatic latent image is formed on the photosensitive drum. Then, the electrostatic latent image is developed by a developing device. Subsequently, thus developed image formed on the photosensitive drum is transferred to a recording medium. Accordingly, an image is formed on a recording medium.

The following structure is known as a guiding structure when the process cartridge is attached to or detached from the apparatus body. The guiding structure is configured such that a first side wall opposite one of side walls of the process cartridge is arranged in a cartridge mounting portion, and first and second apparatus body guides are provided so as to be arranged side by side in a vertical direction, i.e., in the direction of gravitational force, thus allowing the guides to support the one of side walls of the process cartridge. Further, a third apparatus body guide opposite the other side wall of the process cartridge is provided on the cartridge mounting portion to support the other side wall of the process cartridge. With the above structure, inclination of the process cartridge can be avoided when the process cartridge is mounted. Accordingly, the process cartridge can be smoothly mounted into the apparatus body (See Japanese Patent Application Laid-Open No. 2007-219268).

SUMMARY OF THE INVENTION

The present invention is directed to a process cartridge and an electrophotographic image forming apparatus having an improved operability when the process cartridge is mounted into an apparatus body of the electrophotographic image forming apparatus. Further, the present invention is directed to a process cartridge and an electrophotographic image forming apparatus wherein the process cartridge can be mounted into an apparatus body of the electrophotographic image forming apparatus in a stable manner.

According to an aspect of the present invention, a process cartridge that is detachable from an apparatus body of an image forming apparatus includes a photosensitive drum, a first unit configured to rotatably support the photosensitive drum, a developing roller, a second unit configured to rotatably support the developing roller and movably supported with respect to the first unit to allow the developing roller to take an image forming position contacting the photosensitive drum and a non-image forming position keeping away from the photosensitive drum, a first guided portion, provided on the first unit at a downstream side of a mounting direction of the process cartridge, configured to be guided by a first apparatus body guide, which is provided on the apparatus body and extends along the mounting direction of the process cartridge, when the process cartridge is mounted into the apparatus body along an axis line of the photosensitive drum, a second guided portion, provided on the first unit and extending from an upstream side to the downstream side of the mounting direction, configured to be guided by a second apparatus body guide, which is provided on the apparatus body and extending along the mounting direction, when the process cartridge is mounted into the apparatus body along the axis line, and a third guided portion configured to be guided by a third apparatus body guide, which is provided on the apparatus body at the upstream side of the mounting direction, during a process in which the process cartridge is being mounted into the apparatus body along the axis line, and configured to be released from being restricted by the third apparatus body guide when the process cartridge is completely mounted in the apparatus body.

According to another aspect of the present invention, an image forming apparatus for forming an image on a recording medium, from which a process cartridge is detachable, includes (i) a first apparatus body guide extending along a mounting direction of the process cartridge, (ii) a second apparatus body guide extending along the mounting direction, (iii) a third apparatus body guide provided on an apparatus body of the image forming apparatus at an upstream side of the mounting direction, (iv) a mounting portion configured to receive the process cartridge in a detachable manner, the process cartridge including a photosensitive drum, a first unit configured to rotatably support the photosensitive drum, a developing roller, a second unit configured to rotatably support the developing roller and movably supported with respect to the first unit to allow the developing roller to take an image forming position contacting the photosensitive drum and a non-image forming position keeping away from the photosensitive drum, a first guided portion, provided on the first unit at a downstream side of a mounting direction of the process cartridge, configured to be guided by the first apparatus body guide when the process cartridge is mounted into an apparatus body of the image forming apparatus along an axis line of the photosensitive drum, a second guided portion, provided on the first unit and extending from an upstream side to the downstream side of the mounting direction, configured to be guided by the second apparatus body guide when the process cartridge is mounted into the apparatus body along the axis line, and a third guided portion configured to be guided by the third apparatus body guide during a process in which the process cartridge is being mounted into the apparatus body along the axis line, and configured to be released from being restricted by the third apparatus body guide when the process cartridge is completely mounted in the apparatus body, and (v) a conveyance unit configured to convey the recording medium.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

A process cartridge (hereinafter referred to as the "cartridge") and a color electrophotographic image forming apparatus (hereinafter referred to as the "image forming apparatus") according to a first exemplary embodiment of the present invention will be described below with reference to drawings attached hereto.

Figure 1:
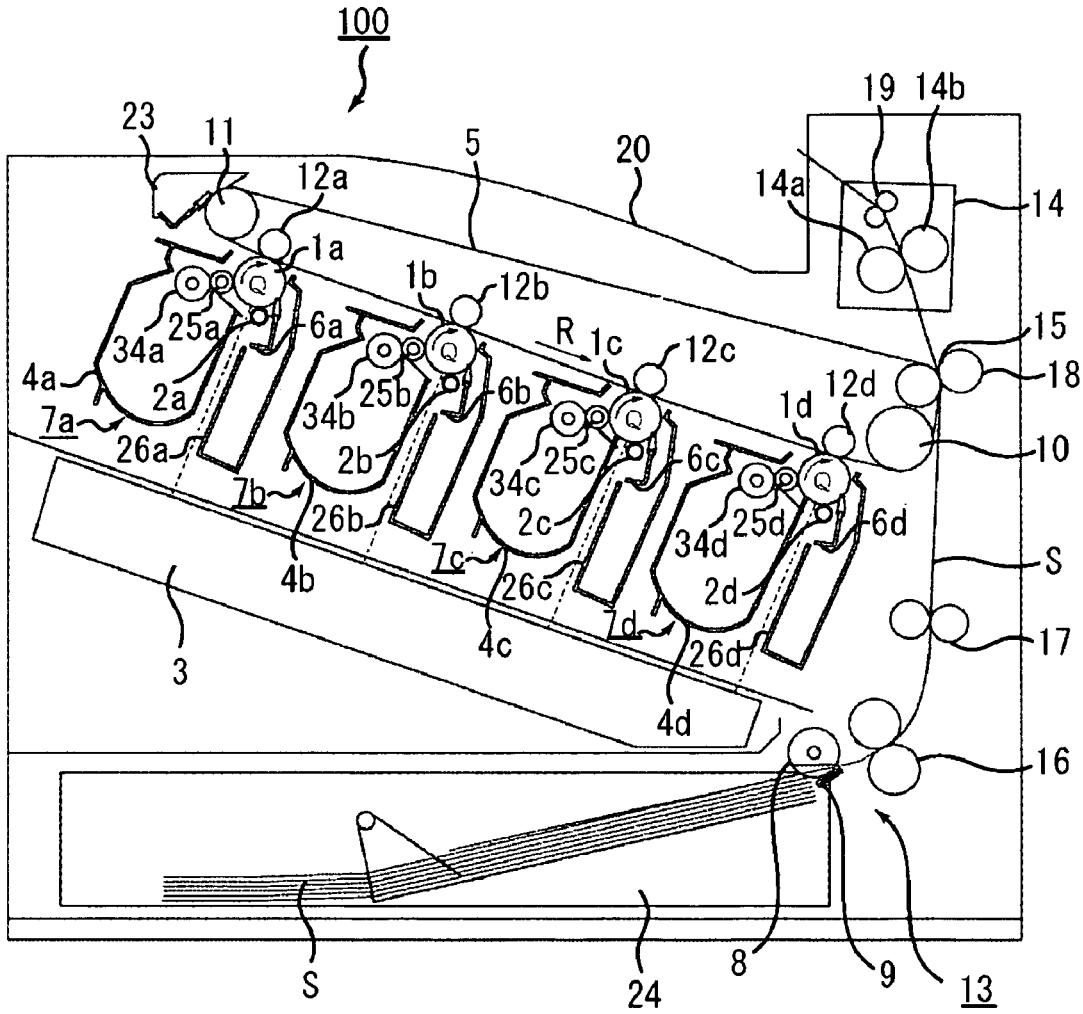
FIG. 1 is an overall structural view of a color electrophotographic image forming apparatus according to an exemplary embodiment of the present invention.

Initially, an overall structure of the image forming apparatus will be described with reference to FIGS. 1 and 3. An image forming apparatus 100 illustrated in FIG. 1 includes four cartridges 7 (7*a* through 7*d*) arranged in parallel to each other and sloping down with respect to a horizontal direction. Each of the cartridges 7 (7*a* through 7*d*) is independently detachable from an apparatus body 100*a* of the image forming apparatus 100. The apparatus body 100*a* is equivalent to the image forming apparatus 100 before receiving cartridges 7 (7*a* through 7*d*). The apparatus body 100*a* includes mounting portions 22 (22*a* through 22*d*) for receiving cartridges 7 (7*a* through 7*d*) (see FIG. 3). The cartridges 7 (7*a* through 7*d*), having been mounted to the corresponding mounting portions 22 (22*a* through 22*d*), each include a single electrophotographic photosensitive drum 1 (1*a* through 1*d*, respectively).

Electrophotographic photosensitive drums (hereinafter referred to as the "photosensitive drum") 1 are rotary driven by driving members (not shown) in a clockwise direction in FIG. 1, respectively. Each of the photosensitive drums 1 is provided with therearound processing units configured to act on the photosensitive drum 1 in sequence along the rotary direction. More specifically, a cleaning member 6 (6*a* through 6*d*) configured to remove developer (hereinafter referred to as the "toner") remaining on a surface of the photosensitive drum 1 after an image is transferred, and a charging roller 2 (2*a* through 2*d*) configured to uniformly charge the surface of the photosensitive drums 1 are arranged around each of the photosensitive drums 1. Further, a developing unit 4 (4*a* through 4*d*) configured to develop an electrostatic latent image formed on the photosensitive drum 1 by using toner is also arranged around each of the photosensitive drums 1. Still further, a scanner unit 3 configured to irradiate laser beams to form electrostatic latent images on the photosensitive drums 1 based on image information and an intermediate transfer belt 5 on which four color-toner images on the photosensitive drums 1 are transferred at one time are arranged around the photosensitive drums 1. The photosensitive drum 1, the cleaning member 6, the charging roller 2, and the developing unit 4 are made into one piece to form a cartridge 7. The cartridge 7 is detachably mounted by a user to the apparatus body 100*a* of the image forming apparatus 100.

The intermediate transfer belt 5 is stretched between a driving roller 10 and a tension roller 11. Primary transfer rollers 12 (12*a* through 12*d*) are arranged inside the intermediate transfer belt 5 opposite the corresponding photosensitive drums 1 (1*a* through 1*d*). A biasing force applying unit (not shown) applies a transfer biasing force to the intermediate transfer belt 5.

Toner images formed on the photosensitive drums 1 are primary transferred to the intermediate transfer belt 5 in a sequential manner by causing each of the photosensitive drums 1 to rotate in an arrow Q direction, causing the intermediate transfer belt 5 to rotate in an arrow R direction, and further applying a positive biasing force to each of the primary transfer rollers 12. Then, the toner images are transferred to the secondary transfer unit 15 while the four color-toner images are overlapped to each other on the intermediate transfer belt 5.

A sheet S as a recording medium is conveyed by a conveyance unit, including a feeding device 13, a registration roller pair 17 and the like, in synchronization with the image forming operation. The feeding device 13 includes a sheet feeding cassette 24 for stacking sheets S, a delivery roller 8 for feeding a sheet S, and a conveyance roller pair 16 for conveying the sheet S fed through the delivery roller 8. The sheet feeding cassette 24 can be withdrawn in a front direction in FIG. 1. The sheets S stacked in the sheet feeding cassette 24 are pressed by the delivery roller 8 and separated one by one by a separating pad 9 (scraper separation method), thereby being conveyed.

Then, the sheet S conveyed from the feeding device 13 is further conveyed to the secondary transfer unit 15 by the registration roller pair 17. In the secondary transfer unit 15, a positive biasing force is applied to the secondary transfer rollers 18. Accordingly, the four cooler-toner images on the intermediate transfer belt 5 are secondary transferred to the sheet S thus conveyed.

A fixing unit 14 fixes the toner image formed on the sheet S by applying heat and pressure. A fixing belt 14*a* is formed into a cylindrical shape and guided by a belt guiding member (not shown) to which a heating unit such as a heater is attached. The fixing belt 14*a* and the pressure roller 14*b* form a fixing nip by having a predetermined pressure welding force therebetween.

Then, the sheet S, on which an unfixed toner image is formed, conveyed from an image forming member is heated and pressed by the fixing nip formed between the fixing belt 14*a* and the pressure roller 14*b*. Accordingly, the unfixed toner image on the sheet S is fixed to the sheet S. Thereafter, the sheet S on which the toner image is fixed is discharged to a discharge tray 20 by a discharge roller pair 19.

On the other hand, the toners remaining on the surfaces of the photosensitive drums 1, after transfer of the toner images, are removed by cleaning units 6, respectively. Thus-removed toners are collected in the removed toner chambers within photosensitive member units 26 (26*a* through 26*d*), respectively.

Toner remaining on the intermediate transfer belt 5 after the secondary transfer to the sheet S is removed by a transfer belt cleaning device 23. Thus-removed toner passes through a waste toner conveyance path (not shown) to be collected by the waste toner collecting container (not shown) arranged at a rear side of the apparatus body 100*a* (see FIG. 3).

Figure 2:
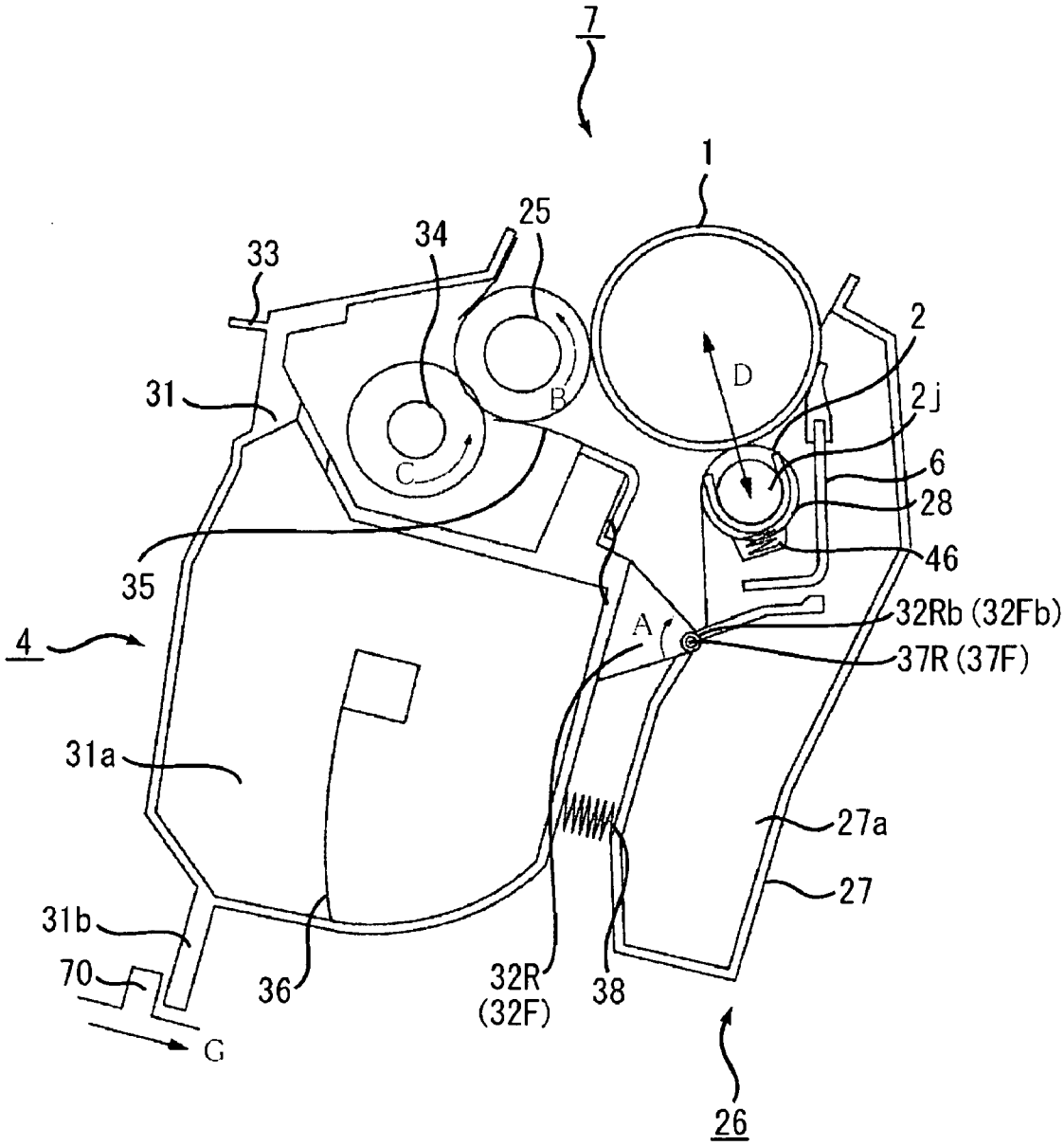
FIG. 2 is a cross sectional view of a cartridge.

Now, the cartridge of the present exemplary embodiment will be described below with reference to FIG. 2. FIG. 2 illustrates a main cross section of the cartridge 7 containing toner t. The same configuration is given to each of the cartridge 7*a* containing yellow toner t, the cartridge 7*b* containing magenta toner t, the cartridge 7*c* containing cyan toner t, and the cartridge 7*d* containing black toner t.

Each of the cartridges 7 includes a photosensitive drum 1, the charging roller 2, the photosensitive member unit 26 with the cleaning unit 6, and the developing unit 4 with the developing roller 25.

The photosensitive drum 1 is rotatably mounted to a cleaning frame member 27 of the photosensitive member unit 26 through a bearing, which will be described below. By transmitting driving force of a driving motor (not shown) to the photosensitive member unit 26, the photosensitive drum 1 is rotary driven according to the image forming operation. On a periphery of the photosensitive drum 1, the charging roller 2 and the cleaning member 6 are arranged as described above. Further, the remaining toner removed from the surface of the photosensitive drum 1 by the cleaning unit 6 drops into the removed toner chamber 27*a*. A charging roller bearing 28 is mounted on the cleaning frame member 27 so as to be movable in an arrow D direction passing through a center of the charging roller 2 and a center of the photosensitive drum 1. A shaft 2*j* of the charging roller 2 is mounted on the bearing 28 in a rotatable manner. The bearing 28 is pressed against the photosensitive drum 1 by the charging roller pressing member 46.

Each of the developing unit 4 includes the developing roller 25, which rotates in an arrow B direction while contacting the photosensitive drum 1, and a development frame member 31. The developing roller 25 is rotatably supported by the development frame member 31 through bearing members 32 (32R, 32L), arranged on both sides of the development frame member 31 in its longitudinal direction. Further, on the periphery of the developing roller 25, there are provided a toner supply roller 34, which rotates in an arrow C direction while contacting the developing roller 25, and a development blade 35 for controlling a toner layer on the developing roller 25. Still further, a toner containing member 31*a* of the development frame member 31 is provided with a toner conveyance member 36 configured to agitate the contained toner and convey the toner to the toner supply roller 34.

An upper section of the developing unit 4 is provided with a third cartridge guided portion 33 (hereinafter referred to as the "third guided portion") of a rib shape and being projected in a direction opposite the developing roller 25 from a side wall of the development frame member 31.

The developing unit 4 is rotatably coupled with the photosensitive member unit 26 with a rotational center of the shafts 37 (37R, 37F) which engages with the corresponding holes 32Rb and 32Fb provided in bearing members 32R and 32F. The developing unit 4 is pressed by a pressure spring 38. Accordingly, in an image forming state of the cartridge 7, the developing unit 4 rotates in an arrow A direction around the shafts 37 and the developing roller 25 contacts the photosensitive drum 1.

The toner frame member 31 of the developing unit 4 is provided with a pressure receiving member 31*b* which projects downward. In an image non-forming state of the cartridge 7, a separating lever 70, illustrated by a chain double-dashed line, moves in an arrow G direction. Accordingly, since the pressure receiving member 31*b* is pressed, the developing unit 4 rotates in a direction opposite the arrow A direction around the shafts 37 and thus the developing roller 25 moves away from the photosensitive drum 1.

Now, how to detachably mount the cartridge 7 according to the present exemplary embodiment in the apparatus body 100*a* will be described below with reference to FIGS. 3 through 5.

Figure 3:
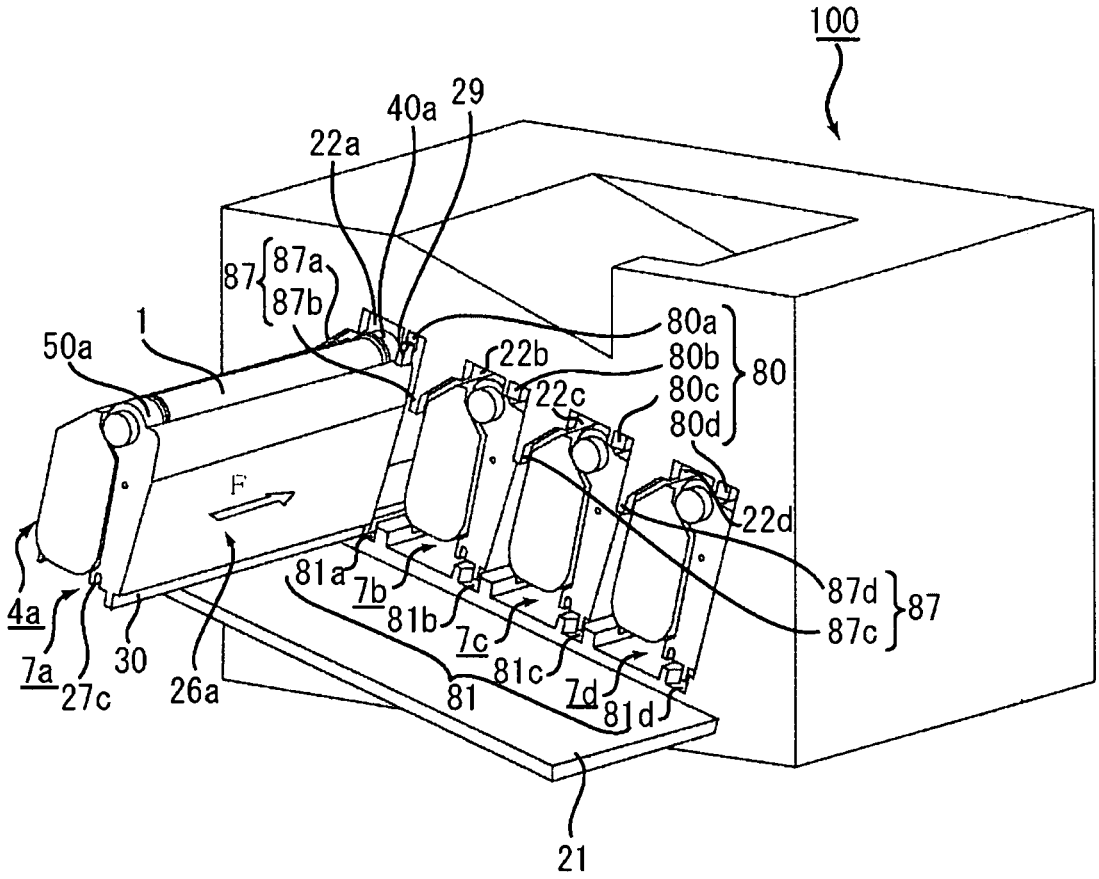
FIG. 3 is a perspective view illustrating a state of an image forming apparatus before the cartridge is mounted in an apparatus body of the image forming apparatus.

FIG. 3 is a perspective view illustrating a state of the cartridge 7 before being mounted in the apparatus body 100*a*. FIG. 4 is a perspective view illustrating an appearance of the cartridge 7. FIG. 5 is a schematic diagram illustrating how to guide and position the cartridge 7 in the apparatus body 100*a*. In the present exemplary embodiment, in mounting the cartridge 7 into the apparatus body 100*a*, the cartridge 7 is inserted in an arrow F direction, which is in parallel with an axis line of the photosensitive drum 1, i.e., from a front side to a rear side in FIG. 1. With the above configuration, the cartridge 7 is detachable from the apparatus body 100*a*. The front side is an upstream side of a mounting direction to mount the cartridge 7 into the apparatus body 100*a*, and the rear side is a downstream side of the mounting direction.

In FIG. 3, the front side of the apparatus body 100*a* is provided with an openable/closable front cover 21. When the front cover 21 is opened, four mounting portions 22 (22*a* through 22*d*) for receiving the cartridges 7 (7*a* through 7*d*) are exposed such that the mounting portions 22 are arranged in parallel with each other and sloping down with respect to a horizontal direction. Upper sides and lower sides of the mounting portions 22 are provided with upper mounting guides 80 (80*a* through 80*d*) as first apparatus body guides and lower mounting guides 81 (81*a* through 81*d*) as second apparatus body guides, respectively. The upper mounting guide 80 and the lower mounting guide 81 are formed into grooves extending from the front side to the rear side of the apparatus body 100*a* along the mounting direction of the cartridge 7 (see FIG. 5). Further, the upper sides of the mounting portions 22 are provided with auxiliary guides 87 (87*a* through 87*d*) as third apparatus body guides, respectively. Each of the auxiliary guides 87 is formed into a projection projecting downward from the upper side of the mounting portion 22 (see FIG. 5).

Figure 4:
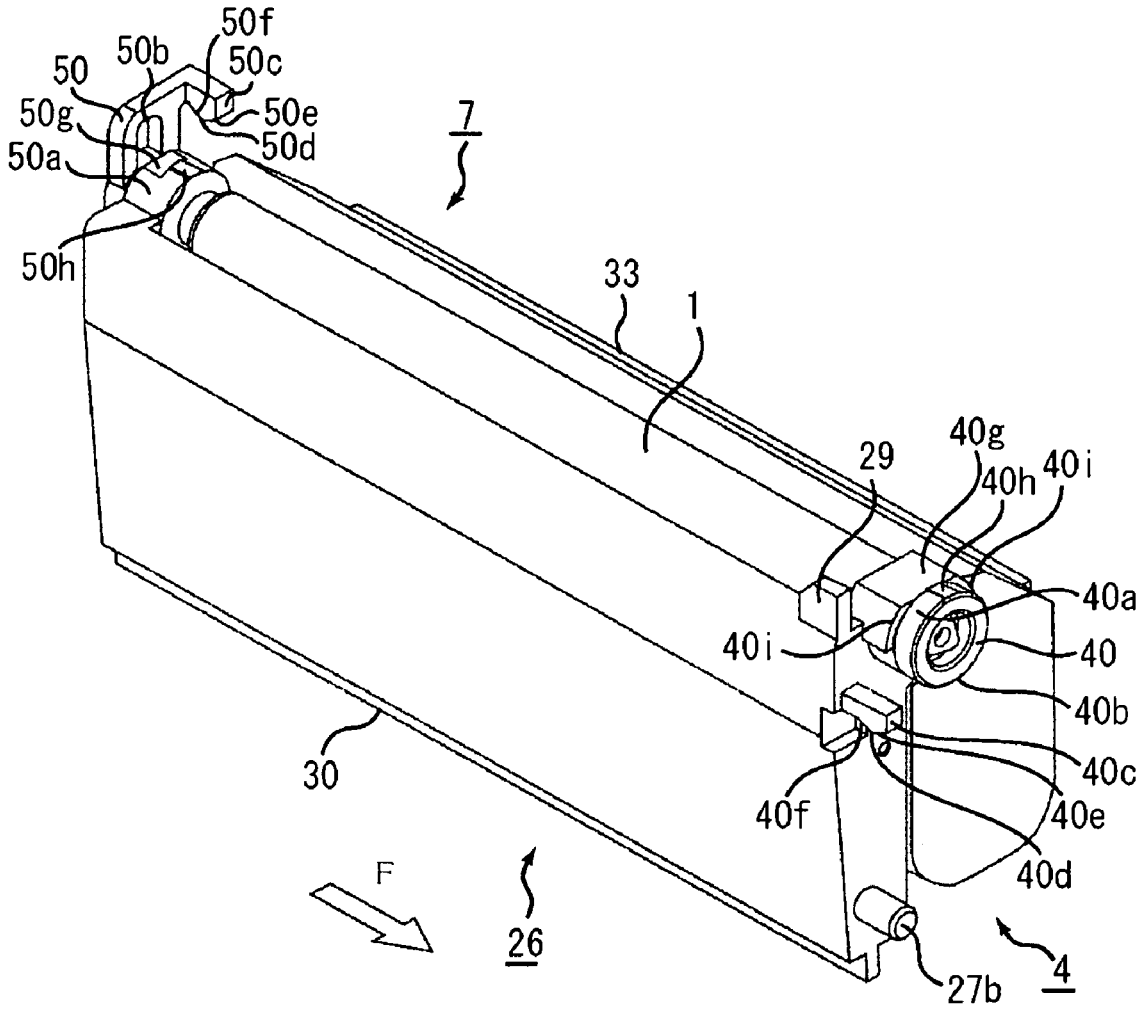
FIG. 4 is a perspective view illustrating an appearance of the cartridge.

On the other hand, as illustrated in FIG. 4, in the photosensitive member unit 26, a first cartridge guided portion 29 and a second cartridge guided portion 30 are provided at positions corresponding to the upper mounting guide 80 and the lower mounting guide 81 provided on the apparatus body 100*a* (see FIG. 5), respectively. (Hereinafter, the first cartridge guided portion is referred to as the first guided portion and the second cartridge guided portion is referred to as the second guided portion.) The first guided portion 29 is arranged at a downstream side (tip end side) of the mounting direction of the cartridge 7 and formed into a projection to be engaged with the groove of the upper mounting guide 80 of the apparatus body 100*a*. Further, the second guided portion 30 is arranged at a bottom surface of the cartridge 7 from the downstream side (tip end side) to the upstream side (rear end side) of the mounting direction along the mounting direction of the cartridge 7. The second guided portion 30 is formed into a projection to be engaged with the groove of the lower mounting guide 81. In the developing unit 4 of the cartridge 7, a third guided portion 33 is provided at a position corresponding to the auxiliary guide 87 provided on the apparatus body 100*a*. The third guided portion 33 is arranged from the downstream side to the upstream side of the mounting direction along the mounting direction of the cartridge 7 in an upper section opposite the first guided portion 29 in a direction orthogonal to the axis line of the photosensitive drum 1. Further, the third guided portion 33 is formed into a projection projecting laterally from a side wall of the developing unit 4. Further, the third guided portion 33 is set to a length whereby restriction of movement by the auxiliary guide 87 is released at a position where the cartridge 7 is completely mounted. Therefore, the third guided portion 33 and the auxiliary guide 87 do not contact each other except for a half-way of the mounting operation.

When the cartridge 7 is mounted into the apparatus body 100*a*, the first guided portion 29 provided on the photosensitive member unit 26 of the cartridge 7 is engaged with the upper mounting guide 80 of the apparatus body 100*a*. Similarly, the second guided portion 30 provided on the photosensitive member unit 26 is engaged with the lower mounting guide 81 of the apparatus body 100*a*. Further, upward and lateral movements of the third guided portion 33 provided on the developing unit 4 are restricted by the auxiliary guide 87 of the apparatus body 100*a*. The cartridge 7 is pushed into an arrow F direction in FIG. 5.

When the cartridge 7 is inserted into a predetermined position, the positioned members 40*a* and 50*a* at the rear side and the front side of the cartridge 7 are positioned in the apparatus body 100*a*, respectively. The cartridge 7 is then completely mounted. In a state that the cartridge 7 is completely mounted, an engagement state between the second guided portion 30 and the second apparatus body guide 81 is maintained. The first guided portion 29 comes into a notch 80*a*1 provided above the first apparatus body guide 80 and the downstream side of the mounting direction, as illustrated in FIG. 5, in the state that the cartridge 7 is completely mounted. In other words, upward restriction of the first guided portion 29 is released with respect to the first apparatus body guide 80. This is because of allowing the cartridge 7 to move upward without the first guided portion 29 contacting the first apparatus body guide 80, when the cartridge 7 is positioned by abutment portions 82*a* of a side board 82, which will be described below. The reason why the first guided portion 29 is provided only at the downstream side of the mounting direction of the cartridge 7 is to allow the first guided portion 29 to detour an area of the intermediate transfer belt 5 provided above the first apparatus body guide 80 when the cartridge 7 is completely mounted. On the other hand, the third guided portion 33 does not contact the auxiliary guide 87 in the state that the cartridge 7 is completely mounted. In order to avoid the cartridge 7 from being rotated upon driving input, a shaft 27*b* projecting toward the downstream side of the mounting direction is provided at the rear side of the cartridge 7 (see FIG. 4), and a U-shaped hole 27*c* is provided in the front side of the cartridge 7. Upon positioning of the cartridge 7, the shaft 27*b* and the hole 27*c* are also engaged with the elongated hole 82*b* (see FIG. 5) and the shaft 92*c* (see FIG. 5) of the apparatus body 100*a*, respectively.

More specifically, in the cartridge 7, the first guided portion 29 is provided only at the downstream side of the mounting direction. Therefore, if there are only the first guided portion 29 and the second guided portion 30, sufficient stability in mounting the cartridge 7 will not be realized since there is no upper guide at the upstream side of the mounting direction of the cartridge 7. To resolve such a problem, the third guided portion 33 is provided on the developing unit 4 to thereby secure stability of the cartridge 7 in mounting into the apparatus body 100*a*. However, as described above, the developing unit 4 needs to be rotatable with respect to the photosensitive member unit 26, so that the third guided portion 33 needs to be configured so as not to contact the auxiliary guide 87 when the cartridge 7 is completely mounted. With such a configuration, the cartridge 7 can be inserted into the apparatus body 100*a* in a stable manner.

How to mount and how to position the cartridge 7 will be described in detail below.

Figure 6:
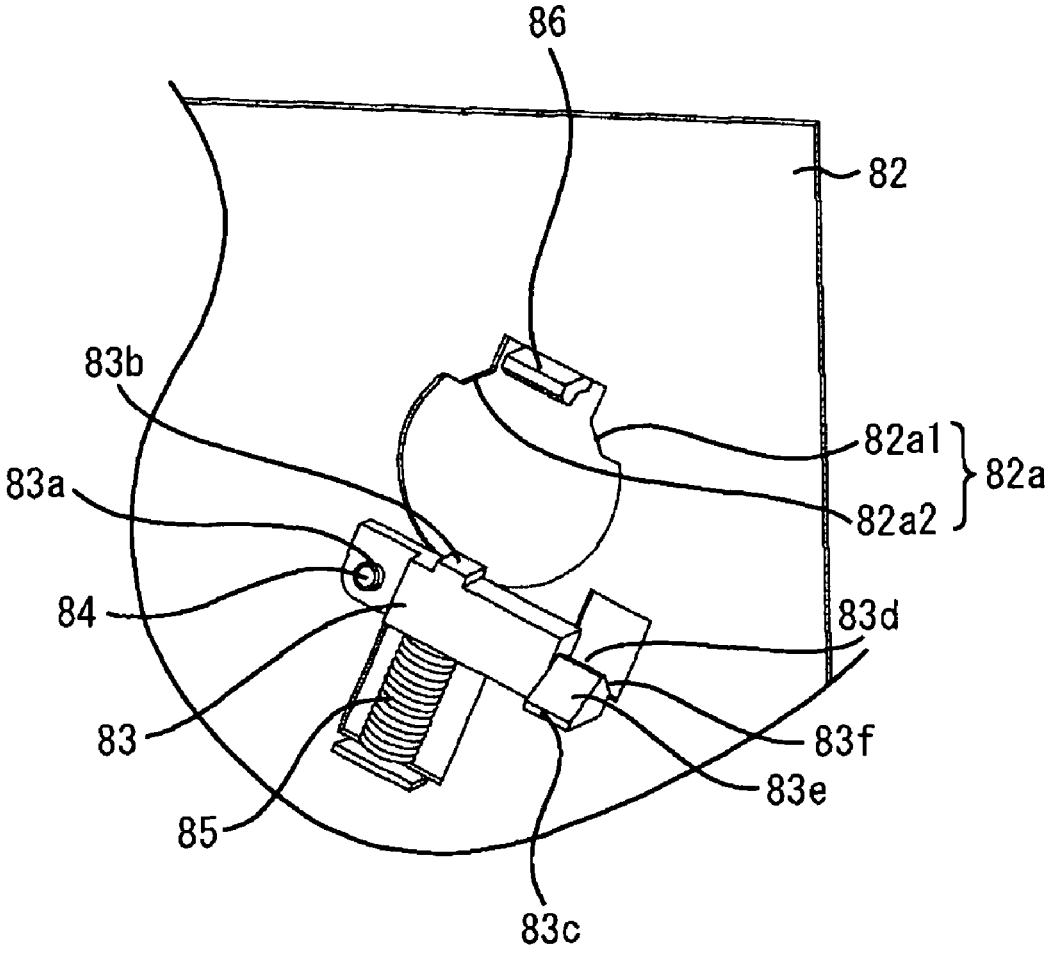
FIG. 6 is a view illustrating in detail how the cartridge is positioned and pressed at a rear side.
Figure 7:
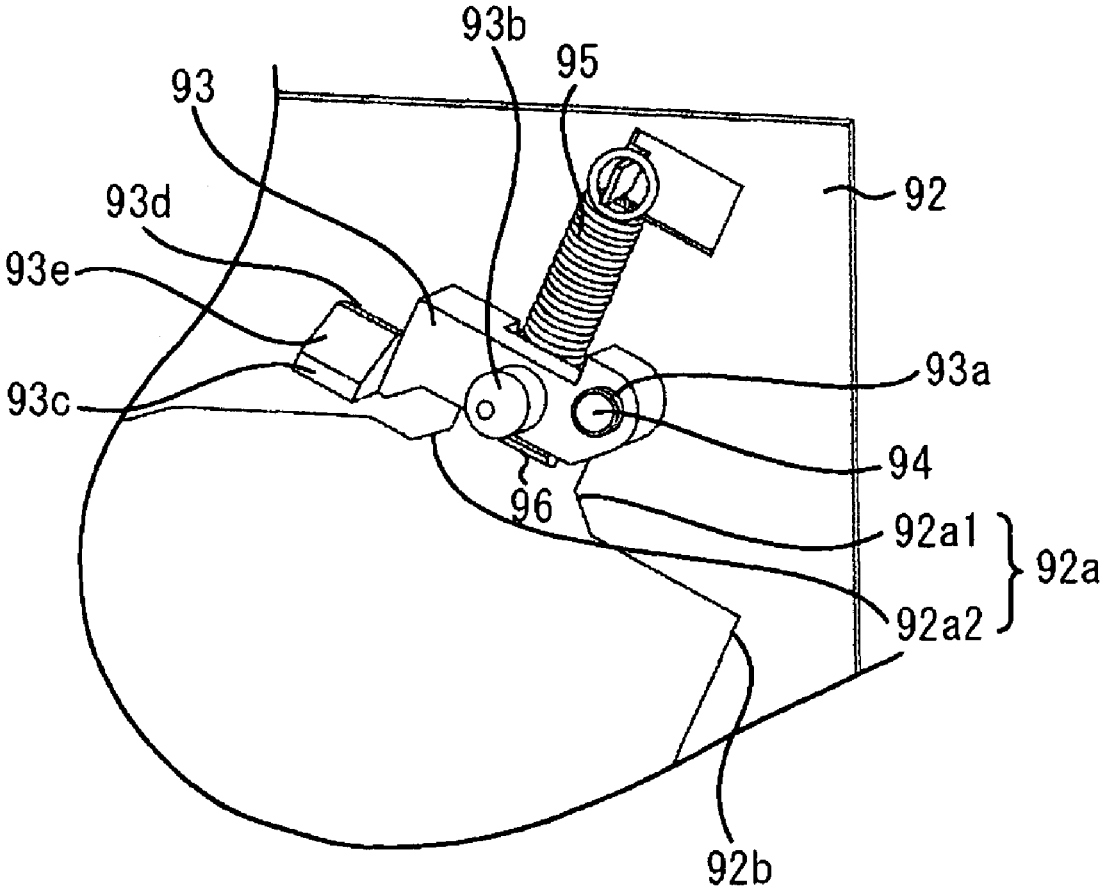
FIG. 7 is a view illustrating in detail how the cartridge is positioned and pressed at a front side.

Now, how to position and how to press the cartridge 7 according to the present exemplary embodiment with respect to the apparatus body 100*a* will be described below with reference to FIGS. 4 through 7. FIG. 6 illustrates in detail how to position and press the cartridge 7 at the rear side, and FIG. 7 illustrates how to position and press the cartridge 7 at the front side.

As illustrated in FIG. 4, the photosensitive drum 1 held by the cartridge 7 is rotatably supported by bearings 40 and 50, of which shafts (not shown) are fixed to the cleaning frame member 27 at both ends, respectively. A first cartridge side positioned member 40*a* is provided on an upper outside surface of the bearing (first bearing member which supports one end side of the photosensitive drum 1 in its axis direction) 40 of the rear side at the downstream side of the mounting direction for mounting the cartridge 7 in the apparatus body 100*a*. More specifically, in a direction perpendicular to the mounting direction of the cartridge 7, an arc-shaped first cartridge positioned member 40*a* is provided to position the rear side of the cartridge 7 in the apparatus body 100*a*. Below the first cartridge positioned member 40*a*, there is provided a pressure receiving portion 40*b*, which receives pressure force (biasing force) from a pressing member (biasing member, push-up member) 83 (see, FIG. 5). Further, there is provided a push-away member 40*c* as a first push-away member for moving the pressing member 83 to a retracted position, when the cartridge 7 is mounted in the apparatus body 100*a*. The push-away member 40*c* projects toward the downstream side of the mounting direction. A tip end of the push-away member 40*c* is provided with a projection 40*d* projecting downward. At the downstream side and the upstream side of the mounting direction of the projection 40*d*, there are slightly-inclined surfaces 40*e* and 40*f*, respectively, extending from a top of the projection 40*d*.

Further, the upper outside surface of the bearing 40 at the rear side is provided with a contact surface 40*h* as a first contact member (first cartridge side restricted member) projecting higher than the first cartridge positioned member 40*a*. The first contact surface 40*h* has a flat upper surface and is arranged in the first cartridge positioned member 40*a*. Further, the first contact surface 40*h* is arranged, with respect to the axis line of the photosensitive drum 1, opposite the pressure receiving portion 40*b* in a direction orthogonal to the axis line of the photosensitive drum 1.

A recessed surface 40*g*, which is lower than the contact surface 40*h*, is provided at the downstream side of the mounting direction of the first contact surface 40*h*. A longitudinal contact surface 40*i* as a longitudinal positioning member of the cartridge 7 is provided on the bearing 40 of the rear side. When the cartridge 7 is mounted in the apparatus body 100*a*, the longitudinal contact surface 40*i* contacts an inner wall surface of the apparatus body sideboard of the rear side.

Now, a bearing (second bearing member for supporting the other end side of the axis line of the photosensitive drum 1) 50 provided at the front side of the mounting direction will be described below. On the upper outside surface of the bearing 50 of the front side, an arc-shaped second cartridge positioned member 50*a* is provided to position the front side of the cartridge 7 in the apparatus body 100*a*, in a direction perpendicular to the mounting direction. Above the second cartridge positioned member, there is provided a pull-up force receiving member 50*b* to which biasing force is applied in a direction in which the cartridge 7 is pulled up from a pull-up member 93 (see FIG. 5).

There is provided a push-away member 50*c* as a second push-away member to move the pull-up member 93 to a retracted position when the cartridge 7 is mounted into the apparatus body 100*a*. The push-away member 50*c* is arranged in a direction orthogonal to the mounting direction at a side surface side of the pull-up force receiving member 50*b*. The push-away member 50*c* projects toward a tip end side of an advancing direction. The tip end of the push-away member 50*c* is provided with a downward projecting projection 50*d*. At a downstream side and an upstream side of the mounting direction of the projection 50*d*, slightly-inclined surfaces 50*e* and 50*f* are provided extending from a top of the projection 50*d*. On the upper outside surface of the bearing 50 of the front side, there is provided a contact surface 50*h* as a second contact member (second cartridge side restricted member) projecting higher than the second cartridge positioned member 50*a*. The second contact surface 50*h*, having a flat upper surface, is arranged in the second cartridge positioned member 50*a*.

On the downstream side of the mounting direction of the second contact surface 50*h*, there is provided a recessed surface 50*g* lower than the contact surface 50*h*.

Now, a cartridge positioning structure of the apparatus body 100*a* will be described below.

Figure 5:
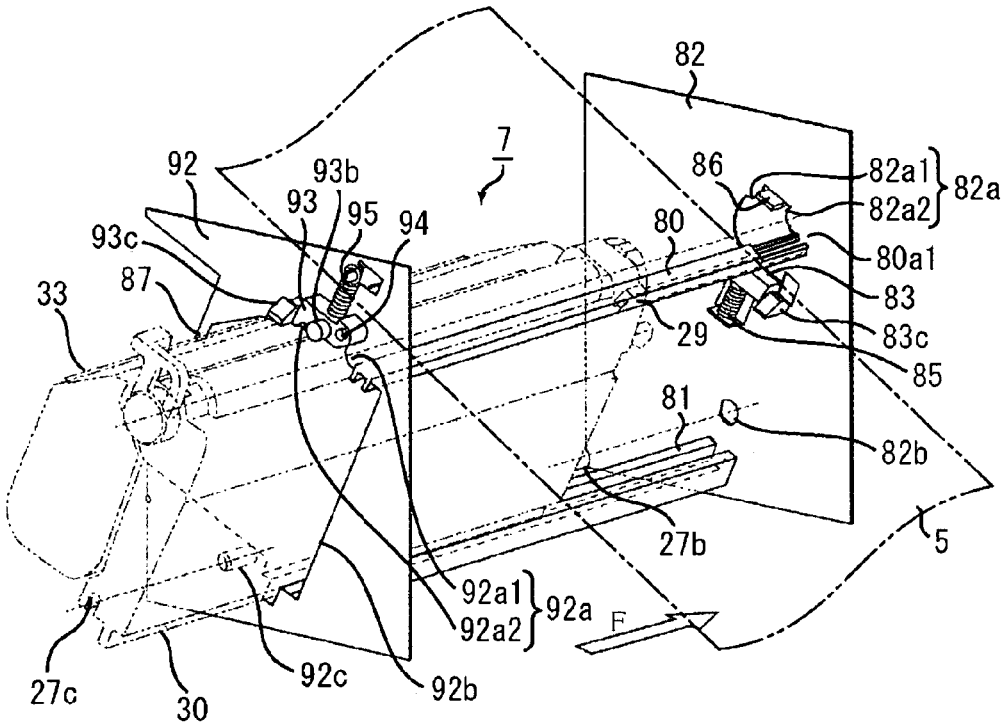
FIG. 5 is a schematic diagram illustrating a positioning structure and a pressing mechanism of the apparatus body.

As illustrated in FIG. 5, the apparatus body 100*a* is provided with a sideboard 82 at the downstream side (rear side) and a sideboard 92 at the upstream side (front side) of the mounting direction.

The side board 92 is provided with the mounting portion 22 (see FIG. 1) whereby the cartridge 7 is detachably mounted to the apparatus body 100*a*. The cartridge 7 is inserted into the apparatus body 100*a* through the mounting portion 22. The cartridge 7 is mounted in the apparatus body 100*a* along the above-described upper mounting guide 80 and lower mounting guide 81 in an arrow F direction.

As illustrated in FIG. 6, the sideboard 82 is provided with two abutment portions 82*a* (82*a*1 and 82*a*2) as apparatus body side-first positioning members for orienting the cartridge 7 in a direction perpendicular to the mounting direction (advancing direction). Further, the sideboard 82 is provided with a pressing member 83 to press the cartridge 7 against the abutment portion 82*a* by using a biasing force (elastic force) of a press spring 85. The pressing member 83 serves, as will be described below, as a pull-up member which pareses and pulls up the cartridge 7 by the pulling up force of the pressing member 83.

The pressing member 83 is arranged below the abutment portion 82*a*. A rotational center 83*a* of the pressing member 83 is engaged with a shaft 84 fixed to the rear side-apparatus body sideboard 82. The pressing member 83 is mounted on the sideboard 82 so as to take either one of a pressing position for pressing the cartridge 7 against the abutment portion 82*a*, a retracted position where the pressing force is released, and a standby position within a moving path of the cartridge 7.

The pressing member 83 is provided, at a position opposite the pressure receiving portion 40*b* of the cartridge 7, with a pressing portion 83*b* for pressing the cartridge 7 at the pressing position. The pressing member 83 is provided, at a position opposite the push-away member 40*c* of the cartridge 7, with a first pushed-away member 83*c* for moving the pressing member 83 to the retracted position. The pushed-away member 83*c* is provided with an upward projecting projection 83*d*. At a downstream side and an upstream side of the mounting direction of the projection 83*d*, slightly-inclined surfaces 83*e* and 83*f* are provided, respectively, extending from a top of the projection 83*d*. The pushed-away member 83*c* is arranged at a position outside of and far from the pressing portion 83*b* with respect to the first rotational center 83*a* in a direction orthogonal to the mounting direction of the cartridge 7. More specifically, the rotational center 83*a*, the pressing portion 83*b*, and the pushed-away member 83*c* are arranged in this order along a longitudinal direction of the pressing member 83.

Between two of the abutment portions 82*a* (82*a*1 and 82*a*2) of the sideboard 82, there is provided a resin made-apparatus body side-first restriction member 86 to restrict upward movement of the cartridge 7 by means of a reaction force generated when the pressing member 83 is pushed away to the retracted position.

As illustrated in FIG. 7, a cartridge insertion hole 92*b* is provided in a sideboard 92. Above the insertion hole 92*b*, two abutment portions 92*a* (92*a*1 and 92*a*2) as apparatus body side-second positioning members are provided to orient the cartridge 7 in a direction perpendicular to the mounting direction. On the apparatus body sideboard 92 of the front side, there is provided a pull-up member 93 to press the cartridge 7 against the abutment portions 92*a* by means of a biasing force (pull force) of a pressing spring 95 such as a tension spring. The pull-up member 93 is arranged above the abutment portion 92*a*. A second rotational center 93*a* of the pull-up member 93 is engaged with a shaft 94 fixed to a front side-apparatus body sideboard 92. The pull-up member 93 is mounted so as to be movable between a pressing position for pressing the cartridge 7 against the abutment portions 92*a*, a retracted position where the pressing force is released from a standby position, and a standby position within a moving path of the cartridge 7.

The pull-up member 93 is provided, at a position opposite the pull-up force receiving member 50*b* of the cartridge 7, with a pull-up force applying member 93*b*, which biases the cartridge 7 in a pull-up direction at a biasing position. A second pushed-away member 93*c* is provided at a position opposite the push-away member 50*c* of the cartridge 7 to allow the pull-up member 93 to move to the retracted position. The pushed-away member 93*c* is provided with an upward projecting projection 93*d*. At the downstream side and the upstream side of the cartridge mounting direction of the projection 93*d*, there are provided slightly-inclined surfaces 93*e*, 93*f*, respectively, extending from a top of the projection 93*d* (see FIGS. 10A through 10C).

In a direction orthogonal to the cartridge mounting direction, the pushed-away member 93*c* is arranged at a position outside of and far away from the pull-up force applying member 93*b* with respect to the rotational center 93*a*. More specifically, the rotational center 93*a*, the pull-up force applying member 93*b*, and the pushed-away member 93*c* are arranged in this order along a longitudinal direction of the pull-up member 93. Further, between two of the abutment portions 92*a* (92*a*1 and 92*a*2) of the front side-apparatus body sideboard 92, there is provided an apparatus body side-second restriction member 96 made of resin to restrict upward movement of the cartridge 7 according to a reaction force generated at a time when the pull-up member 93 is pushed away to the retracted position.

Now, operations in mounting and positioning the cartridge 7 with respect to the apparatus body 100*a* will be described below with reference to FIGS. 8A through 8C and 13.

Figure 8A:
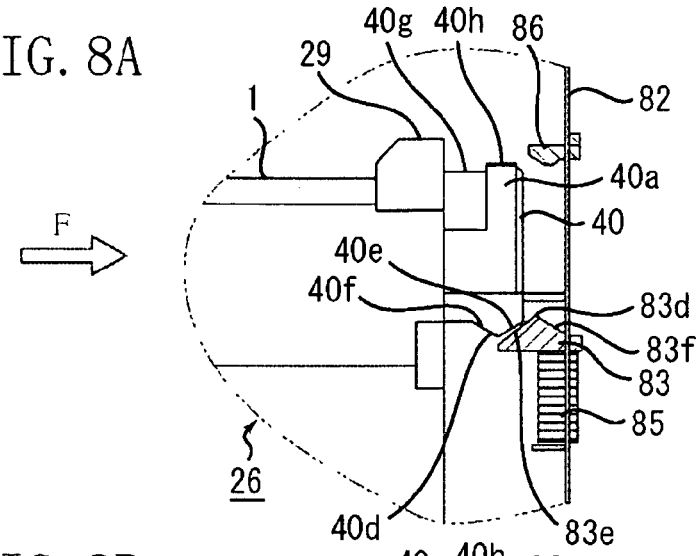
FIGS. 8A through 8C are explanatory diagrams illustrating operations of the pressing mechanism at a rear side as viewed from a right side with respect to a front side of the apparatus body.
Figure 8B:
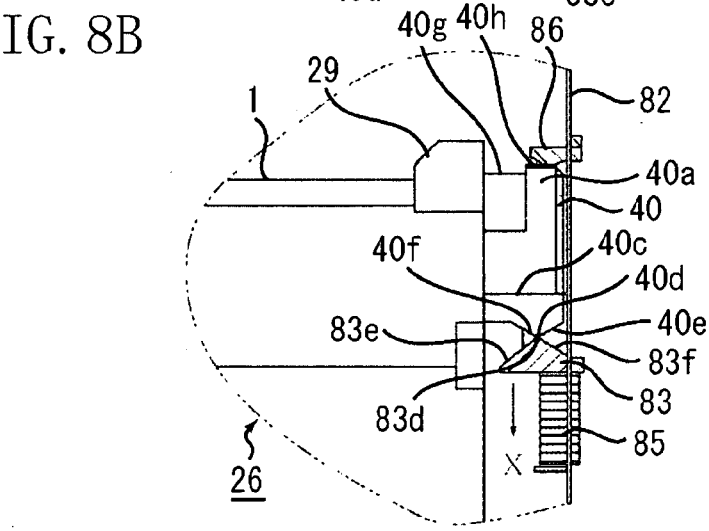
Figure 8C:
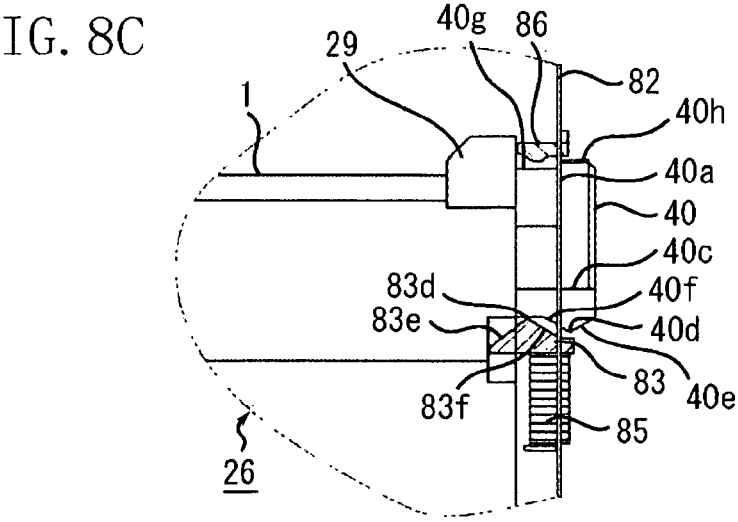
Figure 9A:
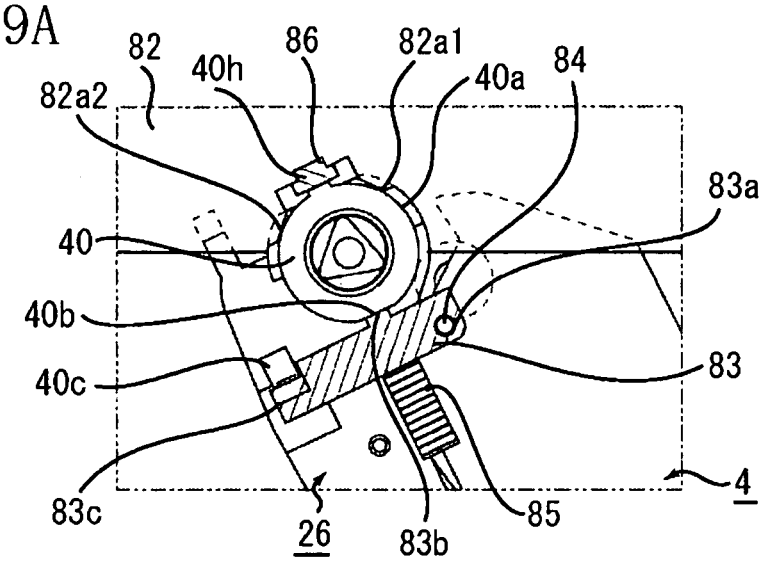
FIGS. 9A through 9C are explanatory diagrams illustrating operations of the pressing mechanism at a rear side as viewed from a rear side with respect to a direction the processor is mounted into the apparatus body.
Figure 9B:
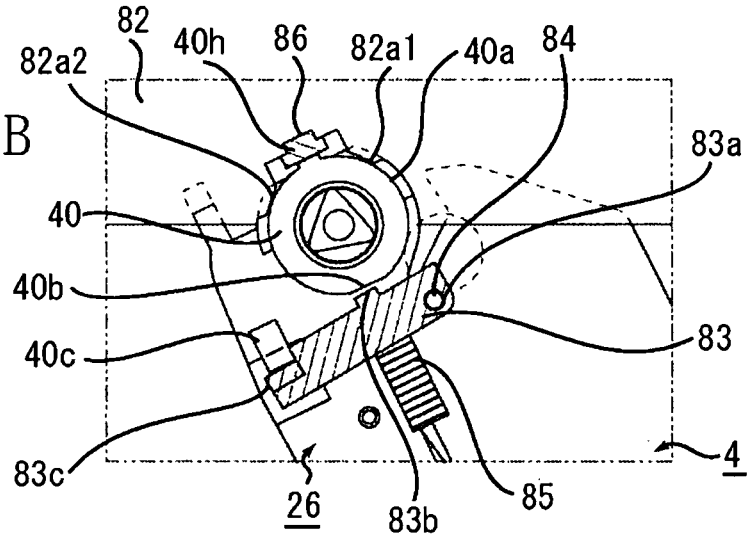
Figure 9C:
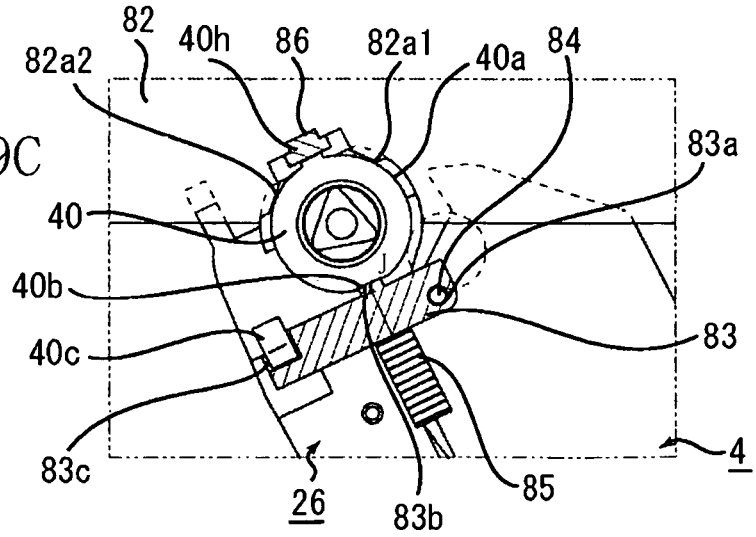
Figure 10A:
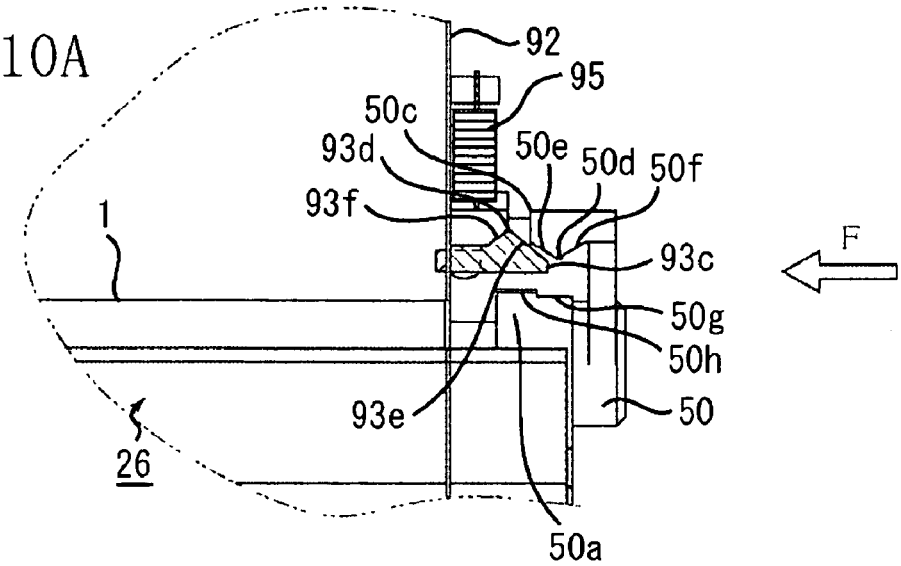
FIGS. 10A through 10C are explanatory diagrams illustrating operations of the pressing mechanism at a front side as viewed from a left side with respect to a front side of the apparatus body.
Figure 10B:
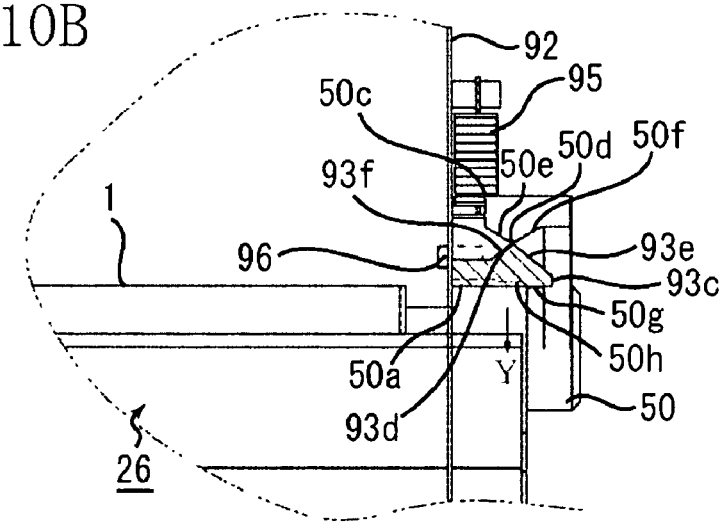
Figure 10C:
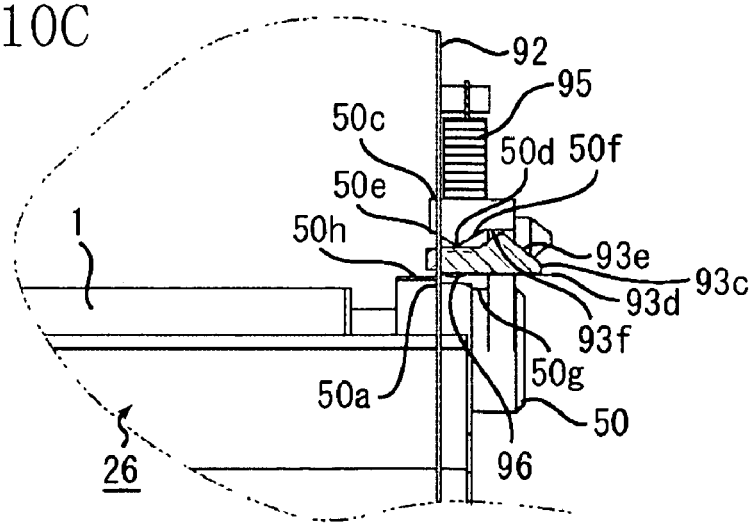
Figure 11A:
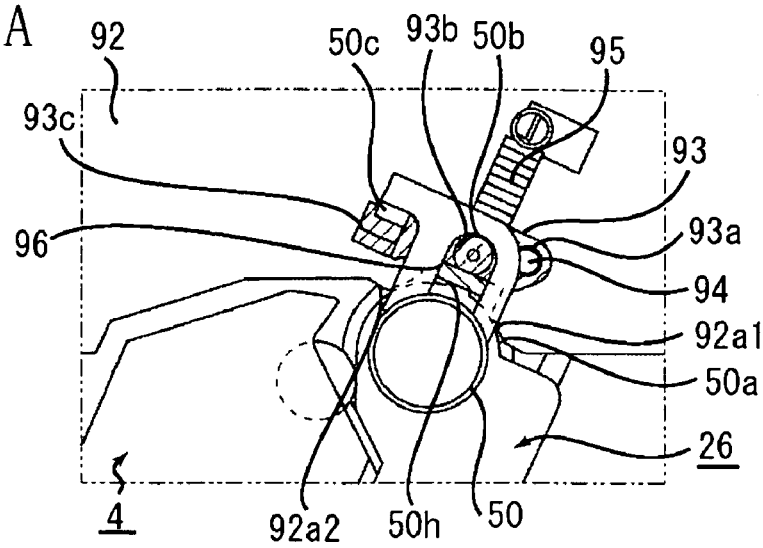
FIGS. 11A through 11C are explanatory diagrams illustrating operations of the pressing mechanism at a front side as viewed from a front side with respect to the direction in which the process cartridge is mounted into the apparatus body.
Figure 11B:
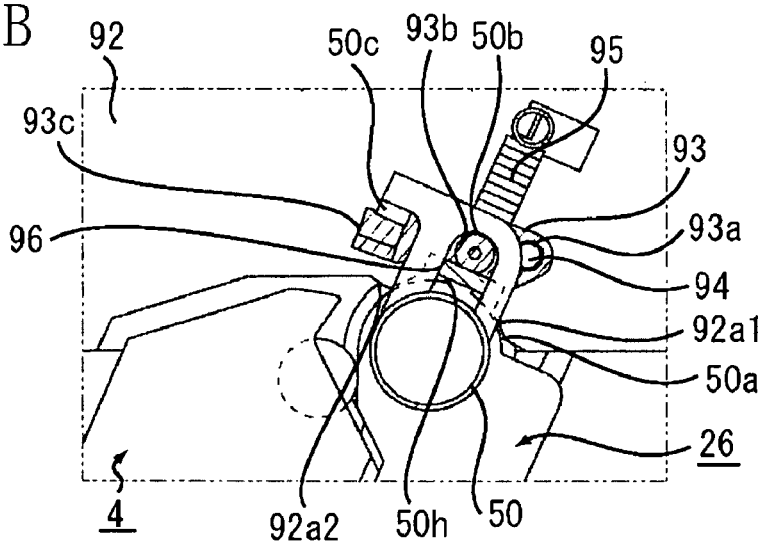
Figure 11C:
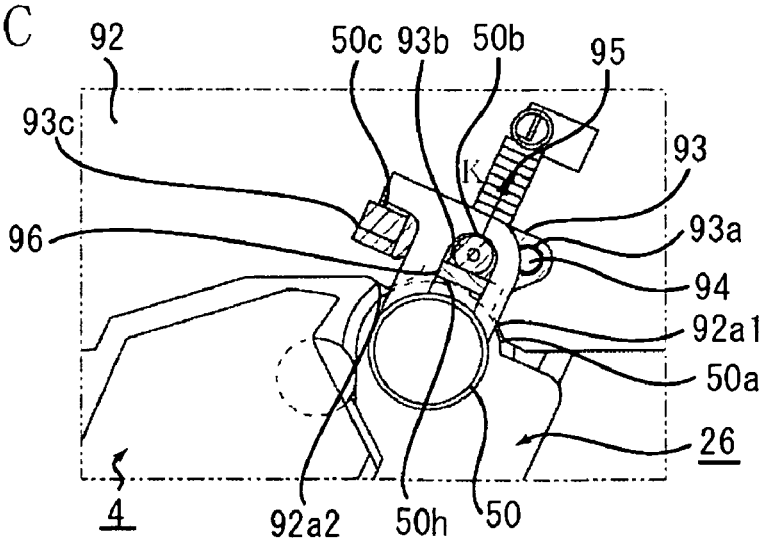
Figure 12:
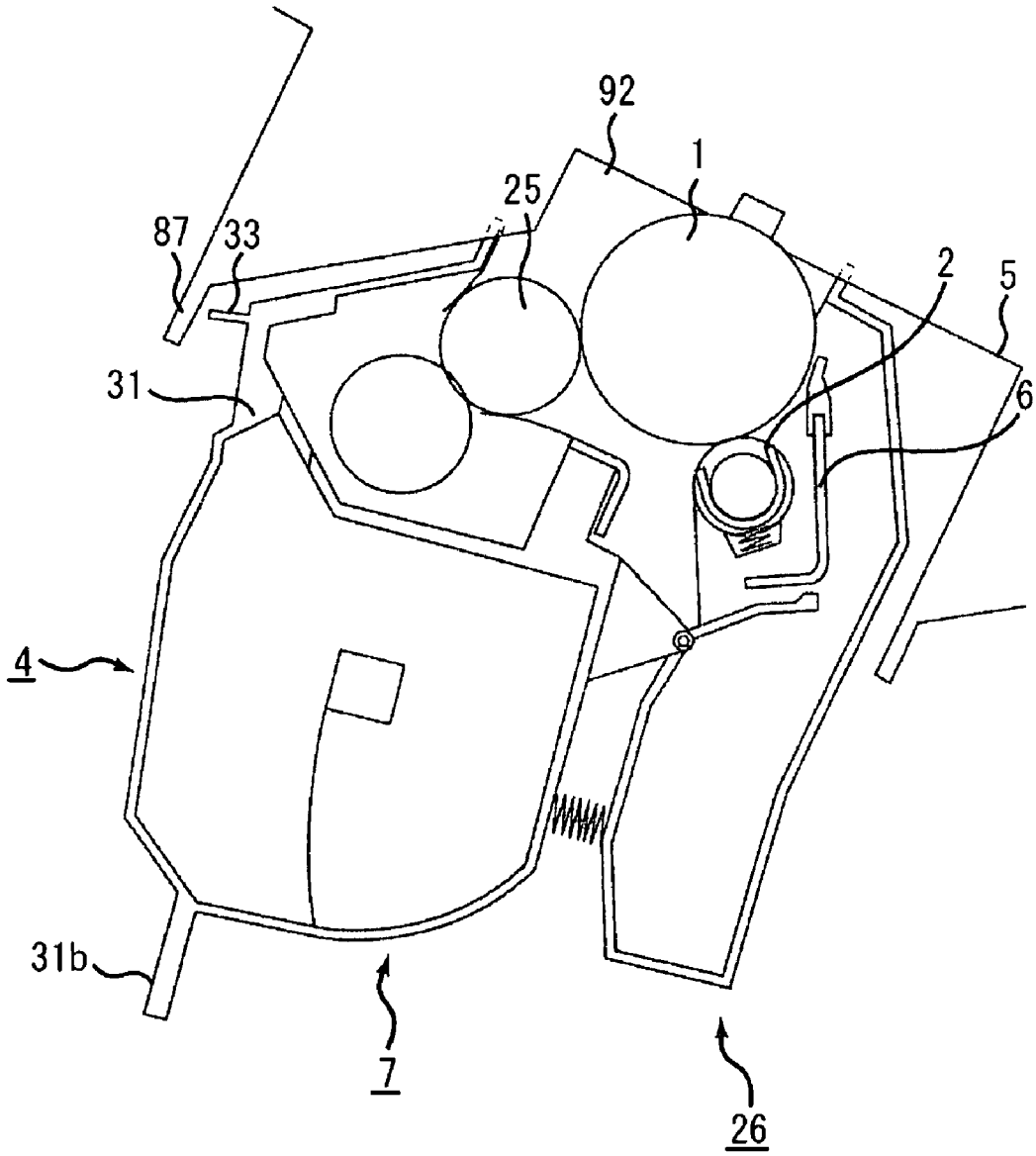
FIG. 12 is a front elevation of the process cartridge when the process cartridge is completely mounted in the apparatus body.
Figure 13:
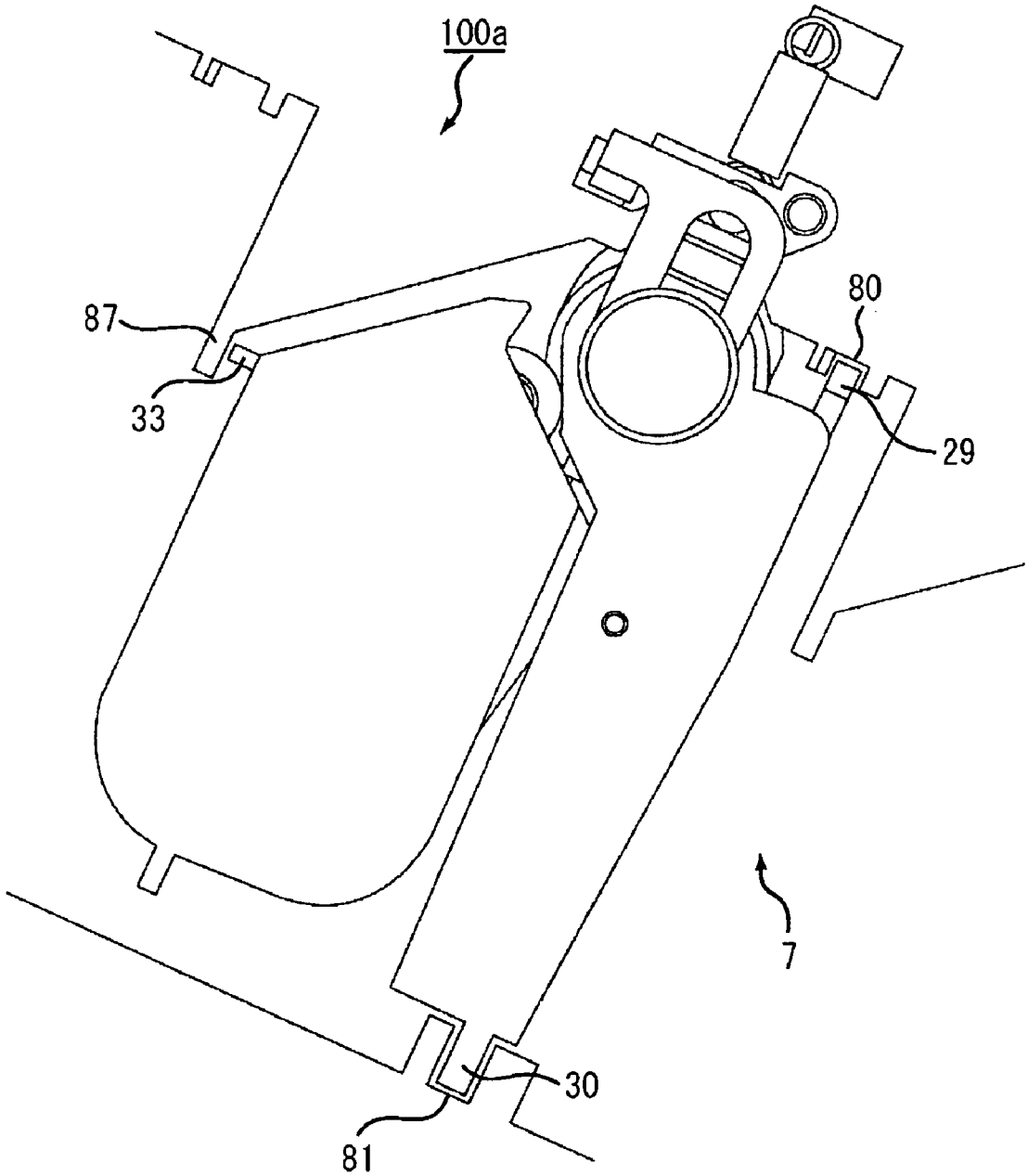
FIG. 13 is a front elevation of the process cartridge on the way the process cartridge is inserted into the apparatus body.
Figure 14:
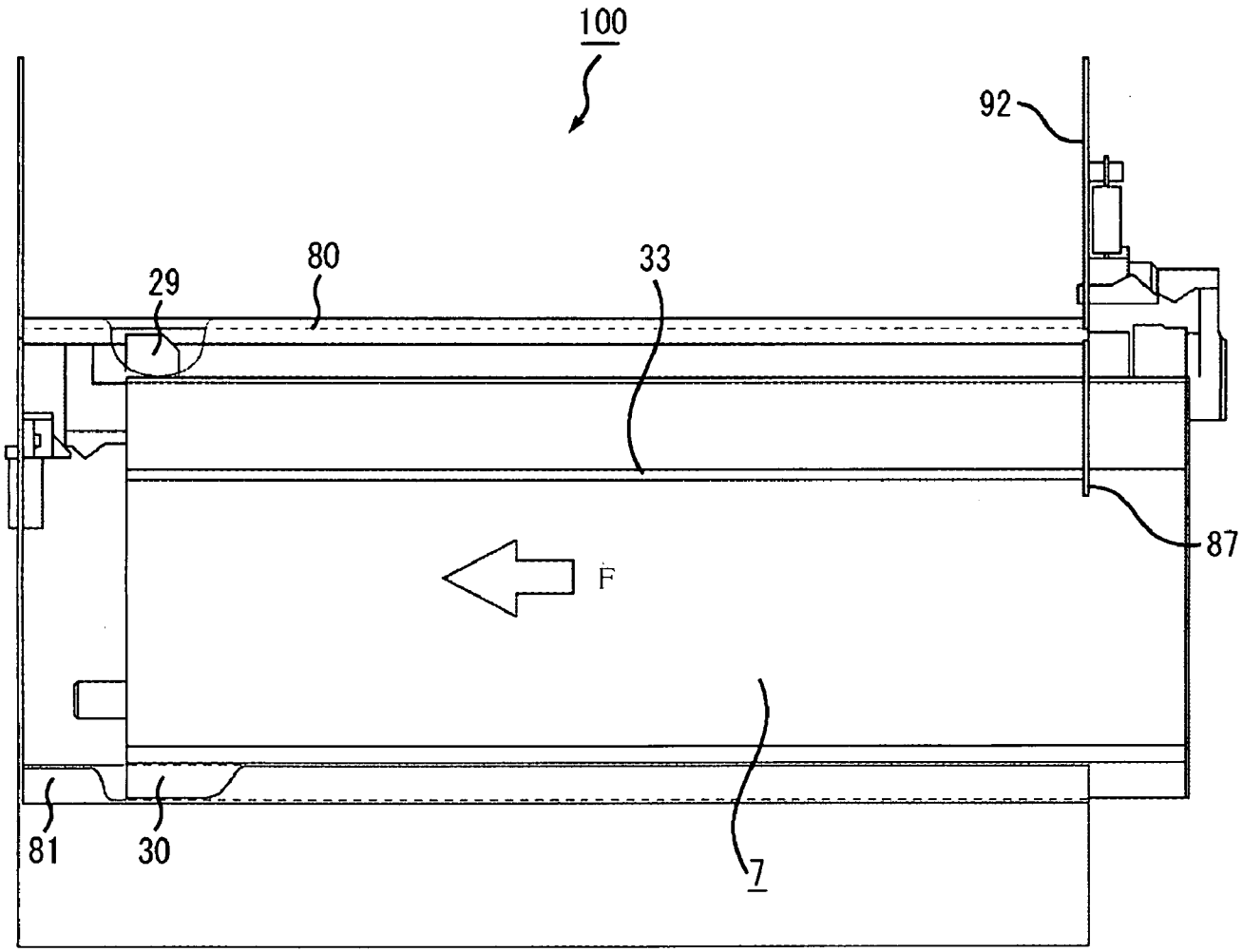
FIG. 14 is a left side view of the process cartridge on the way the process cartridge is mounted into the apparatus body.

FIGS. 8A through 8C illustrate operations of the pressing mechanism located at the rear side as viewed from the right side with respect to the front side of the apparatus body 100*a*. FIGS. 9A through 9C illustrate operations of the pressing mechanism located at the rear side as viewed from the rear side of the cartridge mounting direction. FIGS. 10A through 10C illustrate operations of the pressing mechanism located at the front side as viewed from the left side with respect to the front side of the apparatus body 100*a*. FIGS. 11A through 11C illustrate operations of the pressing mechanism located at the front side as viewed from the front side of the cartridge mounting direction. FIG. 12 is a front elevation illustrating the state in which the cartridge 7 is completely mounted. FIG. 13 is a front elevation illustrating the state in which the cartridge 7 is on the way of being inserted into the apparatus body 100*a*. FIG. 14 is a left side view illustrating the state in which the cartridge 7 is on the way of being mounted into the apparatus body 100*a*. In FIG. 14, an engaging portion between the first guided portion 29 and the upper mounting guide 80 and an engaging portion between the second guided portion 30 and the lower mounting guide 81 are illustrated in a partial cross sectional view.

The cartridge 7, in a state of being positioned in the apparatus body 100*a*, is pulled up by the pressing member 83 and the pull-up member 93. This is because, as illustrated in FIG. 12, an upper contour of the cartridge 7 is inserted into a space higher than the front side sideboard 92 while the cartridge 7 is mounted in the apparatus body 100*a* to bring the intermediate transfer belt 5, illustrated by a chain double-dashed line, into contact with the photosensitive drum 1. In order to withdraw the cartridge 7, in a state of being pulled-up to be mounted, from the apparatus body 100*a*, the cartridge 7 is to be once lowered to withdraw. Similarly, when the cartridge 7 is mounted into the apparatus body 100*a*, the cartridge 7 is to be once lowered to withdraw.

When mounting the cartridge 7 into the apparatus body 100*a* as described above, the user engages the first guided portion 29 of the cartridge 7 with the upper mounting guide 80 of the apparatus body 100*a* and pushes the cartridge 7 in the arrow F direction, as illustrated in FIG. 3. Similarly, the user engages the second guided portion 30 with the lower mounting guide 81 and pushes the cartridge 7 in the arrow F direction. Further, the user pushes the cartridge 7 in the arrow F direction while allowing upward and lateral movements of the third guided portion 33 to be restricted by the auxiliary guide 87.

When the cartridge 7 is inserted into the apparatus body 100*a*, as illustrated in FIG. 13, the first guided portion 29 of the cartridge 7 engages with the upper mounting guide 80 of the apparatus body 100*a*. Therefore, one upper end of the cartridge 7 at the downstream side of the mounting direction is guided laterally and upward by the apparatus body 100*a* in the mounting direction. Similarly, the second guided portion 30 of the cartridge 7 engages with the lower mounting guide 81 of the apparatus body 100*a*. Therefore, a lower side of the cartridge 7 is guided by the apparatus body 100*a* laterally and downward in the mounting direction. Further, upward and lateral movements of the third guided portion 33 of the cartridge 7 are restricted by the auxiliary guide 87. Accordingly, at an entrance of the cartridge mounting portion 22, the other upper end of the cartridge 7 is guided laterally and upward by the apparatus body 100*a*.

When the cartridge 7 is pushed into the apparatus body 100*a* to allow the cartridge 7 to reach a position illustrated in FIG. 14, the third guided portion 33 is positioned at a position where the third guided portion 33 comes into the rear side of the mounting direction more than the auxiliary guide 87, in the mounting direction of the cartridge 7. Accordingly, upward and lateral movement restriction of the third guided portion 33 by the auxiliary guide 87 is released. On the other hand, the first guided portion 29 and the second guided portion 30 are engaged with the upper mounting guide 80 and the lower mounting guide 81, respectively. Therefore, an upper side of the cartridge 7 is guided at the downstream side of the mounting direction, and the lower side of the cartridge 7 is guided throughout from the upstream side to the downstream side of the mounting direction.

When the cartridge 7 is further inserted, in the downstream side of the mounting direction, as illustrated in FIGS. 8A and 9A, the inclined surface 40*e* of the push-away member 40*c* provided on the bearing 40 of the rear side of the cartridge 7 contacts the inclined surface 83*e* of the pushed-away member 83*c* (standby position). Then, as the cartridge 7 is further inserted, the pressing member 83 is gradually pushed down to bring the projection 40*d* of the push-away member 40*c* into contact with the projection 83*d* of the pushed-away member 83*c* as illustrated in FIG. 8B. Accordingly, the pressing member 83 moves in an arrow X direction to be retracted (retracted position).

At the time, as illustrated in FIG. 9B, the pressing member 83 is retracted back to a position where the pressing portion 83*b* does not contact the pressure receiving portion 40*b* of the cartridge 7. Therefore, in the course of mounting the cartridge 7, no pressing force is applied to the pressure receiving portion 40*b*. The pressing force applied from the pressing member 83 when mounting the cartridge 7 is released by the push-away member 40*c* arranged at a position far from the rotational center 83*a*.

As the cartridge 7 is further inserted, the push-away member 40*c* moves away from the pushed-away member 83*c*, and therefore, the pressing member 83 gradually comes back to the pressing position from the retracted position. Then, the contact surface 40*i* as a positioning member of the cartridge 7 in its longitudinal direction is inserted until the contact surface 40*i* strikes on the rear side-apparatus body sideboard 82. As illustrated in FIGS. 8C and 9C, the pressing portion 83*b* contacts the pressure receiving portion 40*b*, thereby the cartridge 7 being pushed in an arrow J direction (pressing direction, FIG. 9C) (pressing position). At the time, the cartridge 7 is positioning in a direction perpendicular to the mounting direction because the positioned member 40*a* strikes on the abutment portion 82*a* of the rear side-apparatus body sideboard 82.

As to the upstream side of the mounting direction, when the cartridge 7 is inserted in a similar manner to that in the case of the downstream side, the inclined surface 50*e* of the push-away member 50*c* provided on the bearing 50 of the front side of the cartridge 7 contacts the inclined surface 93*e* of the pushed-away member 93*c*, as illustrated in FIGS. 10A and 11A (standby position). Then, as the cartridge 7 is inserted, the pull-up member 93 is gradually pushed down. As a result, the pull-up member 93 moves in an arrow Y direction to be retracted (retracted position) because the projection 50*d* of the push-away member 50*c* contacts the projection 93*d* of the pushed-away member 93*c* as illustrated in FIG. 10B.

At this time, as illustrated in FIG. 11B, the pull-up member 93 comes back to a position where the pull-up force applying member 93*b* does not contact the pull-up force receiving member 50*b* of the cartridge 7. Therefore, in the course of mounting the cartridge 7, no biasing force is applied to the pull-up force receiving member 50*b*. The pressing force applied from the pull-up member 93 when the cartridge 7 is mounted is released by the push-away member 50*c* arranged at a position farther than the pull-up force receiving member 50*b* from the rotational center 93*a*.

When the cartridge 7 is further inserted, the push-way member 50*c* moves away from the pushed-away member 93*c*, and the pull-up member 93 gradually returns from the retracted position back to the pressing position. Then, the cartridge 7 is inserted until the contact surface 40*i* as the positioning member of the longitudinal direction of the cartridge 7 strikes on the rear side-apparatus body sideboard 82. Then, as illustrated in FIGS. 10C and 11C, the pull-up force applying member 93*b* contacts the pull-up force receiving member 50*b* (pressing position). Then, the cartridge 7 is pressed in an arrow K direction (pull-up direction, FIG. 11C). At this time, the cartridge 7 is positioned in a direction perpendicular to the mounting direction as the positioned member 50*a* strikes on the abutment portion 92*a* of the front side-apparatus body sideboard 92.

Even in such a positioned state, restriction of upward and lateral movements of the third guided portion 33 by the auxiliary guide 87 is released. Therefore, as illustrated in FIG. 2, the third guided portion 33 does not contact the auxiliary guide 87 when the separating lever 70 is moved in an arrow G direction to separate the developing roller 25 from the photosensitive drum 1. Accordingly, in a state that the cartridge 7 is positioned in the apparatus body 100*a*, the developing roller 25 can be separated from or brought into contact with the photosensitive drum 1 by swinging the developing unit 4.

When the cartridge 7 is positioned, as described above, in the downstream side of the mounting direction, the shaft 27*b* of the cartridge 7 is engaged with the elongated hole 82*b* of the apparatus body 100*a*. Further, in the upstream side of the mounting direction, the hole 27*c* of the cartridge 7 is engaged with the shaft 92*c* of the apparatus body 100*a*. A distance between an engaging portion of the shaft 27*b* and the elongated hole 82*b* and an engaging portion of the hole 27*c* and the shaft 92*c* is made narrower than a distance between an engaging portion of the first guided portion 29 and the upper mounting guide 80 and an engaging portion of the second guided portion 30 and the lower mounting guide 81. With the above setting, since guiding portions would not contact each other in the positioning state, the cartridge 7 can be precisely positioned with respect to the apparatus body 100*a*. Further, the cartridge 7 can be smoothly attached to/detached from the apparatus body 100*a* and is thus excellent in usability.

In the present exemplary embodiment, the third guided portion 33 is made into a projection projecting from the side wall of the developing unit 4. However, the third guided portion 33 may be used with a corner of the frame used as the third guided portion without providing a projection.

Figure 15:
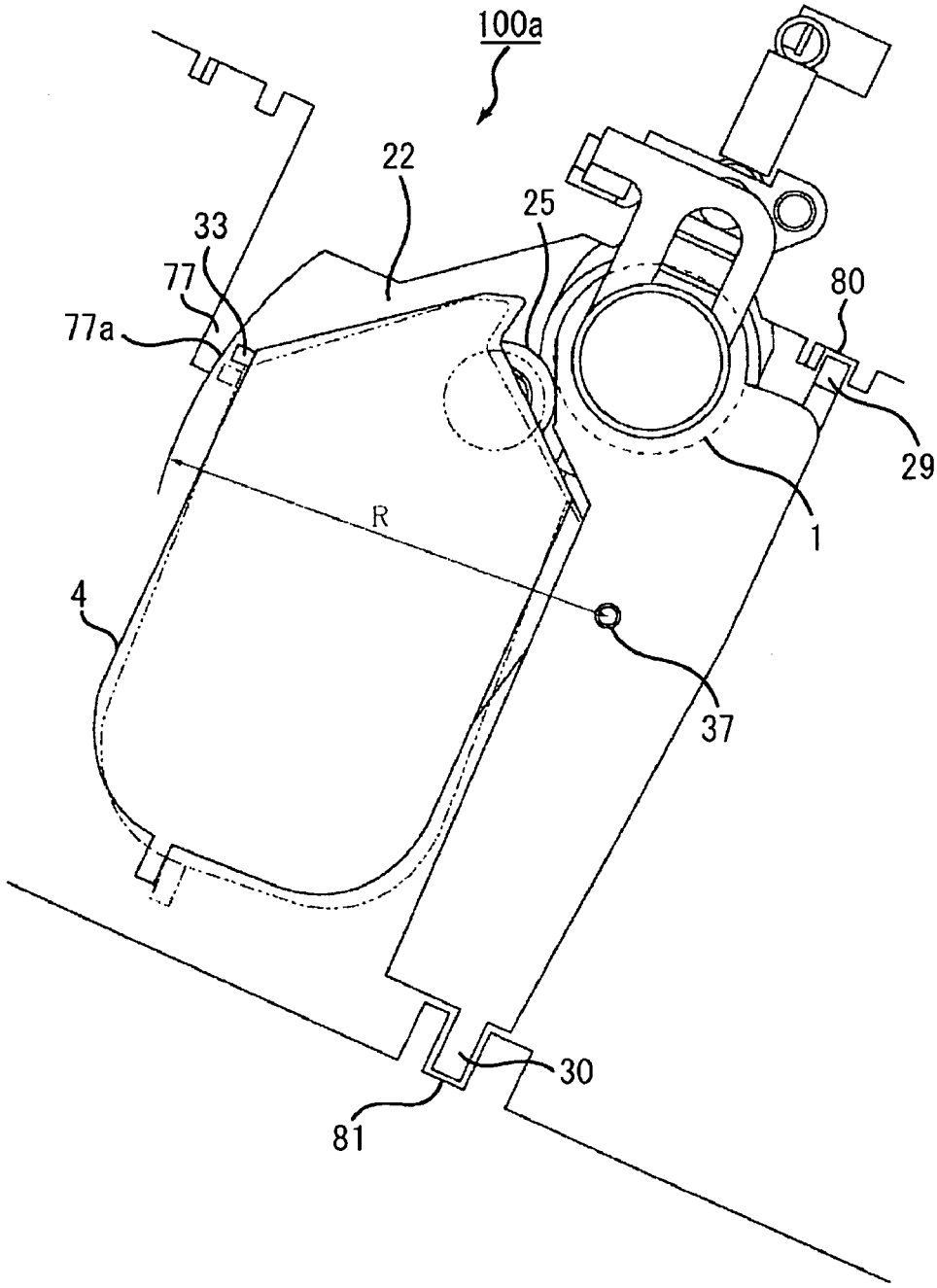
FIG. 15 is a front elevation of the process cartridge on the way the process cartridge is inserted into the apparatus body.

Now, a second exemplary embodiment of the present invention will be described in detail below with reference to FIG. 15. FIG. 15 is a front elevation illustrating the state in which the cartridge 7 is on the way of being mounted into the apparatus body 100*a*.

The second exemplary embodiment of the present invention has a configuration of the auxiliary guide 87 different from that of the image forming apparatus of the first exemplary embodiment.

In the present exemplary embodiment, similar to the first exemplary embodiment, the upper side and the lower side of the mounting portion 22 of the cartridge 7 are provided with the upper mounting guide 80 as the first apparatus body guide and the lower mounting guide 81 as the second apparatus body guide, respectively. The upper mounting guide 80 and the lower mounting guide 81 are formed into grooves extending from the front side to the rear side of the apparatus body 100*a* along the mounting direction of the cartridge 7. The upper side of each mounting portion 22 is provided with an auxiliary guide 77 as the third apparatus body guide. The auxiliary guide 77 is formed into a projection projecting downward from an upper portion of the mounting portion 22. The third guided portion 33 and the opposite surface 77*a*, when attaching/detaching the cartridge 7, are formed into arc shapes having general concentric circles with the shaft 37 as a rotational (swinging) center of the developing unit 4 with respect to the photosensitive member unit 26 when the cartridge 7 is mounted in the apparatus body 100*a*.

When the cartridge 7, positioned at the image forming position where the photosensitive drum 1 contacts the developing roller 25, is mounted in the apparatus body 100*a*, as illustrated in FIG. 15, the first guided portion 29 of the cartridge 7 engages with the upper mounting guide 80 of the apparatus body 100*a*. Therefore, one upper end of the downstream side of the mounting direction of the cartridge 7 is guided laterally and upward by the apparatus body 100*a* in the mounting direction. Similarly, the second guided portion 30 of the process cartridge 7 is engaged with the lower mounting guide 81 of the apparatus body 100*a*. Therefore, the lower side of the cartridge 7 is guided laterally and downward by the apparatus body 100*a* in the mounting direction. Further, upward and lateral movements of the third guided portion 33 of the cartridge 7 are restricted by the auxiliary guide 77. Therefore, at the entrance of the cartridge mounting portion 22, the other upper end of the cartridge 7 is guided laterally and downward by the apparatus body 100*a*.

On the other hand, the cartridge 7 in a non-image forming state where the photosensitive drum 1, illustrated by a chain double-dashed line in FIG. 15, is separated from the developing roller 25, is mounted in the apparatus body 100*a*. In this case, similar to the above-described image forming state, the first guided portion 29 of the cartridge 7 is engaged with the upper mounting guide 80 of the apparatus body 100*a*. Therefore, an upper end of the cartridge 7 at the downstream of the mounting direction is guided laterally and upward in the mounting direction by the apparatus body 100*a*. Similarly, the second guided portion 30 of the cartridge 7 is engaged with the lower mounting guide 81 of the apparatus body 100*a*. Therefore, the lower side of the cartridge 7 is guided laterally and downward by the apparatus body 100*a* in the mounting direction. Upward and lateral movements of the third guided portion 33 of the cartridge 7 are restricted by the auxiliary guide 77. Therefore, at the entrance of the cartridge mounting portion 22, the other upper end of the cartridge 7 is guided laterally and downward by the apparatus body 100*a*.

As described above, the opposite surface 77*a* with respect to the third guided portion 33 of the auxiliary guide 77 is formed into an arc-shape having a general concentric circle of the developing unit 4 when the cartridge 7 is mounted into the apparatus body 100*a*. Accordingly, a guiding relationship between the third guided portion 33 and the opposite surface 77*a* will not change regardless of the position of the developing unit 4 whether it is in the image forming position or in the non-image forming position. Consequently, the cartridge 7 can be mounted into the apparatus body 100*a* regardless of the position of the developing unit 4 with respect to the photosensitive member unit 26.

As described above, according to an exemplary embodiment of the present invention, in mounting a process cartridge in an apparatus body, the process cartridge and the electrophotographic image forming apparatus improved in operability can be provided.

According to an exemplary embodiment of the present invention, such a process cartridge and an electrophotographic image forming apparatus can be provided that the process cartridge can be mounted in an apparatus body in a stable state.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-138044 filed May 27, 2008 and No. 2009-086152 filed Mar. 31, 2009, which are hereby incorporated by reference herein in their entirety.

What is claimed is:

1. A process cartridge that is detachable from an apparatus body of an image forming apparatus, the process cartridge comprising:

a photosensitive drum;

a first unit configured to rotatably support the photosensitive drum;

a developing roller;

a second unit configured to rotatably support the developing roller and movably supported with respect to the first unit to allow the developing roller to take an image forming position contacting the photosensitive drum and a non-image forming position keeping away from the photosensitive drum;

a first guided portion, provided on the first unit at a downstream side of a mounting direction of the process cartridge, configured to be guided by a first apparatus body guide, which is provided on the apparatus body and extends along the mounting direction of the process cartridge, when the process cartridge is mounted into the apparatus body along an axis line of the photosensitive drum;

a second guided portion, provided on the first unit and extending from an upstream side to the downstream side of the mounting direction, configured to be guided by a second apparatus body guide, which is provided on the apparatus body and extending along the mounting direction, when the process cartridge is mounted into the apparatus body along the axis line; and a third guided portion, provided on the second unit, configured to be guided by a third apparatus body guide, which is provided on the apparatus body at the upstream side of the mounting direction, during a process in which the process cartridge is being mounted into the apparatus body along the axis line, and configured to be released from being restricted by the third apparatus body guide when the process cartridge is completely mounted in the apparatus body.

2. The process cartridge according to claim 1, wherein the first guided portion includes a projection projecting upward in a state in which the process cartridge is mounted in the apparatus body.

3. The process cartridge according to claim 1, wherein the second guided portion includes a projection projecting downward in a state in which the process cartridge is mounted in the apparatus body.

4. The process cartridge according to claim 1, wherein the first guided portion comes into a notch provided on the first apparatus body guide at a downstream side of the mounting direction when mounting the process cartridge is completed.

5. An image forming apparatus for forming an image on a recording medium, from which a process cartridge is detachable, the image forming apparatus comprising:

(i) a first apparatus body guide extending along a mounting direction of the process cartridge;

(ii) a second apparatus body guide extending along the mounting direction;

(iii) a third apparatus body guide provided at an upstream side of the mounting direction;

(iv) a mounting portion configured to receive the process cartridge in a detachable manner, the process cartridge comprising:

a photosensitive drum;

a first unit configured to rotatably support the photosensitive drum;

a developing roller;

a second unit configured to rotatably support the developing roller and movably supported with respect to the first unit to allow the developing roller to take an image forming position contacting the photosensitive drum and a non-image forming position keeping away from the photosensitive drum;

a first guided portion, provided on the first unit at a downstream side of a mounting direction of the process cartridge, configured to be guided by the first apparatus body guide when the process cartridge is mounted into an apparatus body of the image forming apparatus along an axis line of the photosensitive drum;

a second guided portion, provided on the first unit and extending from an upstream side to the downstream side of the mounting direction, configured to be guided by the second apparatus body guide when the process cartridge is mounted into the apparatus body along the axis line; and a third guided portion, provided on the second unit, configured to be guided by the third apparatus body guide during a process in which the process cartridge is being mounted into the apparatus body along the axis line, and configured to be released from being restricted by the third apparatus body guide when the process cartridge is completely mounted in the apparatus body; and (v) a conveyance unit configured to convey the recording medium.

6. The image forming apparatus according to claim 5, wherein the second unit is provided to be rotatable around a rotational center with respect to the first unit, and wherein the third apparatus body guide has an arc shape with a center as the rotational center.

7. The image forming apparatus according to claim 5, wherein the first apparatus body guide includes a groove.

8. The image forming apparatus according to claim 5, wherein the second apparatus body guide includes a groove.

9. The image forming apparatus according to claim 5, wherein the first apparatus body guide has a notch provided at the downstream side of the mounting direction, into which the first guided portion comes when mounting the process cartridge is completed.

10. A process cartridge that is detachable from an apparatus body of an image forming apparatus including an intermediate transfer belt to which a toner image is transferred, the process cartridge comprising:

a photosensitive drum;

a first unit configured to rotatably support the photosensitive drum;

a developing roller;

a second unit configured to rotatably support the developing roller and movably supported with respect to the first unit to allow the developing roller to take an image forming position contacting the photosensitive drum and a non-image forming position keeping away from the photosensitive drum;

a first guided portion, provided on the first unit at a downstream side of a mounting direction of the process cartridge and at a position to detour an area of the intermediate transfer belt in the mounting direction of the process cartridge when the process cartridge is mounted into the apparatus body, configured to be guided by a first apparatus body guide, which is provided on the apparatus body and extends along the mounting direction of the process cartridge, when the process cartridge is mounted into the apparatus body along an axis line of the photosensitive drum;

a second guided portion, provided on the first unit and extending from an upstream side to the downstream side of the mounting direction, configured to be guided by a second apparatus body guide, which is provided on the apparatus body and extending along the mounting direction, when the process cartridge is mounted into the apparatus body along the axis line; and a third guided portion provided on the second unit and extending from the downstream side to the upstream side of the mounting direction, a length of the third guided portion being set such that the third guided portion contacts a third apparatus body guide, which is provided on the apparatus body at the upstream side of the mounting direction, and restricts the process cartridge from moving in a direction intersecting the mounting direction of the process cartridge during a process in which the process cartridge is being mounted into the apparatus body along the axis line and such that the third guided portion is not in contact with the third apparatus body guide at a position where the process cartridge is completely mounted in the apparatus body.

11. The process cartridge according to claim 10, wherein the first guided portion includes a projection projecting upward in a state in which the process cartridge is mounted in the apparatus body.

12. The process cartridge according to claim 10, wherein the second guided portion includes a projection projecting downward in a state in which the process cartridge is mounted in the apparatus body.

13. An image forming apparatus for forming an image on a recording medium, the image forming apparatus comprising:

(i) a first apparatus body guide extending along a mounting direction to mount the process cartridge into an apparatus body;

(ii) a second apparatus body guide extending along the mounting direction;

(iii) a third apparatus body guide provided on the apparatus body at an upstream side of the mounting direction and an intermediate transfer belt to which a toner image is transferred;

(iv) a mounting portion;

(v) the process cartridge to be received by the mounting portion in a detachable manner, the process cartridge comprising:

a photosensitive drum;

a first unit configured to rotatably support the photosensitive drum;

a developing roller;

a second unit configured to rotatably support the developing roller and movably supported with respect to the first unit to allow the developing roller to take an image forming position contacting the photosensitive drum and a non-image forming position keeping away from the photosensitive drum;

a first guided portion, provided on the first unit at a downstream side of a mounting direction of the process cartridge and at a position to detour an area of the intermediate transfer belt in the mounting direction of the process cartridge when the process cartridge is mounted into the apparatus body, configured to be guided by the first apparatus body guide when the process cartridge is mounted into an apparatus body of the image forming apparatus along an axis line of the photosensitive drum;

a second guided portion, provided on the first unit and extending from an upstream side to the downstream side of the mounting direction, configured to be guided by the second apparatus body guide when the process cartridge is mounted into the apparatus body along the axis line; and a third guided portion provided on the second unit and extending from the downstream side to the upstream side of the mounting direction, a length of the third guided portion being set such that the third guided portion contacts the third apparatus body guide and restricts the process cartridge from moving in a direction intersecting the mounting direction of the process cartridge during a process in which the process cartridge is being mounted into the apparatus body along the axis line and such that the third guided portion is not in contact with the third apparatus body guide at a position where the process cartridge is completely mounted in the apparatus body; and (vi) a conveyance unit configured to convey the recording medium.

14. The image forming apparatus according to claim 13, wherein the second unit is provided to be rotatable around a rotational center with respect to the first unit, and wherein the third apparatus body guide has an arc shape with a center as the rotational center.

15. The image forming apparatus according to claim 13, wherein the first apparatus body guide includes a groove.

16. The image forming apparatus according to claim 13, wherein the second apparatus body guide includes a groove.

* * * * *